US005922145A

United States Patent [19]

Watari et al.

[11] Patent Number: 5,922,145

[45] Date of Patent: Jul. 13, 1999

[54] STEEL PRODUCTS EXCELLENT IN MACHINABILITY AND MACHINED STEEL PARTS

[75] Inventors: Koji Watari, Nishinomiya; Yasutaka Okada, Nara, both of Japan

[73] Assignee: Sumitomo Metal Industries, Ltd., Osaka, Japan

[21] Appl. No.: 09/103,566

[22] Filed: Jun. 24, 1998

Related U.S. Application Data

[63] Continuation of application No. PCT/JP97/04297, Nov. 25, 1997.

[30] Foreign Application Priority Data

| | | | |
|---|---|---|---|
| Nov. 25, 1996 | [JP] | Japan | 8-313673 |
| Jan. 9, 1997 | [JP] | Japan | 9-001974 |
| Jan. 30, 1997 | [JP] | Japan | 9-016047 |
| Feb. 27, 1997 | [JP] | Japan | 9-043062 |
| Feb. 27, 1997 | [JP] | Japan | 9-043138 |
| Mar. 28, 1997 | [JP] | Japan | 9-077346 |
| Mar. 28, 1997 | [JP] | Japan | 9-077369 |

[51] Int. Cl.[6] ..... C22C 38/14

[52] U.S. Cl. ..... 148/320; 420/41; 420/42

[58] Field of Search ..... 148/320; 420/41, 420/42

[56] References Cited

U.S. PATENT DOCUMENTS

| | | | |
|---|---|---|---|
| 4,662,953 | 5/1987 | Giles, Jr. | 420/126 |
| 5,102,619 | 4/1992 | Garrison, Jr. et al. | 420/109 |
| 5,236,521 | 8/1993 | Shikanai et al. | 420/126 |

FOREIGN PATENT DOCUMENTS

| | | |
|---|---|---|
| 34-2405 | 4/1959 | Japan . |
| 49-65918 | 6/1974 | Japan . |
| 62-196359 | 8/1987 | Japan . |
| 62-202054 | 9/1987 | Japan . |
| 62-207821 | 9/1987 | Japan . |
| 1-319651 | 12/1989 | Japan . |
| 2-111842 | 4/1990 | Japan . |
| 4-141550 | 5/1992 | Japan . |
| 6-145890 | 5/1994 | Japan . |
| 6-212347 | 8/1994 | Japan . |
| 6-279849 | 10/1994 | Japan . |
| 7-054100 | 2/1995 | Japan . |
| 7-166235 | 6/1995 | Japan . |
| 7-268538 | 10/1995 | Japan . |

OTHER PUBLICATIONS

Tetsu–To–Hagane (vol. 57 (1971) S484).

*Primary Examiner*—Deborah Yee
*Attorney, Agent, or Firm*—Burns, Doane, Swecker & Mathis, L.L.P.

[57] ABSTRACT

The present invention is directed to steel products which exhibit excellent machinability and are suitable for steel stocks of structural steel parts for a variety of machinery, such as transportation machinery including automobiles, machinery for industrial use, construction machinery, and the like; as well as to a variety of machined structual steel parts for machinery such as crankshafts, connecting rods, gears, and the like. The steel products of the present invention are endowed with excellent machinability and have the following composition based on % by weight: C: 0.05% to 0.6%; S: 0.002% to 0.2%; Ti: 0.04% to 1.0%; N: 0.008% or less; Nd: 0% to 0.1%; Se: 0% to 0.5%; Te: 0% to 0.05%; Ca: 0% to 0.01%; Pb: 0% to 0.5%; and Bi: 0% to 0.4%; wherein the maximum diameter of titanium carbosulfide contained in the steel is not greater than 10 $\mu$m, and its amount expressed in the index of cleanliness of the steel is equal to or more than 0.05%. The machined parts, according to the present inventions are manufactured by subjecting the steel products of the invention to a machining process, and are useful as structural steel parts for a variety of machinery, such as transportation machinery including automobiles, machinery for industrial use, construction machinery, and the like.

23 Claims, No Drawings

STEEL PRODUCTS EXCELLENT IN MACHINABILITY AND MACHINED STEEL PARTS

This application is a continuation of application Ser. No. PCT\JP97\04297, filed Nov. 25, 1997 and which designates the United States of America.

TECHNICAL FIELD

The entire disclosure of the International application No. PCT/JP97/04297, filed on Nov. 25, 1997 including specification, claims and summary, are incorporated herein by reference in its entirety.

The present invention relates to steel products which exhibit excellent machinability, as well as to machined steel parts. More particularly the invention relates to steel products which exhibit excellent machinability and are suitable for steel stocks of structural steel parts for a variety of machinery such as transportation machinery including automobiles, machinery for industrial use, construction machinery, and the like, and to a variety of machined structural steel parts for machinery, such as crankshafts, connecting rods, gears, and the like.

TECHNICAL BACKGROUND

In conventional manufacture of structural steel parts for a variety of machinery such as transportation machinery, machinery for industrial use, construction machinery, and the like, such steel parts are generally either (a) formed roughly into predetermined shapes through hot working, then formed into desired shapes through machining, followed by thermal refining through quenching and tempering, or (b) subjected to hot workings and then quenching and tempering, followed by machining.

However, as structural parts for machinery have been improved to be of high strength, the cost for machining has been increased accordingly. Therefore, for ease of machining and for lowering the costs there is an increased demand for free cutting steel having excellent machinability.

It is well known that the machinability of steel is improved through addition of free-cutting elements (machinability-improving elements) such as Pb, Te, Bi, Ca and S, singly or in combination. For this reason, in order eggs to improve machinability of steels such as steels for machine structural use, there has been employed the method of incorporating the above free-cutting elements into the steels. However, when the free-cutting elements are merely incorporated into steels for machine structural use and the like, in many cases the desired mechanical properties (for example, toughness and fatigue strength) cannot be secured.

Under these circumstances, a technique comprising hot working and then machining, followed by quenching and tempering, as described in (a) above is disclosed in Patent Application Laid-open (Kokai) Nos. 2-111842 and 6-279849. This technique involves "hot rolled steel products endowed with excellent machinability and hardenability" in which C is present in steel as graphite and the machinability of the steel is improved through utilization of the notch effect and lubrication effect of graphite; as well as the "method of manufacturing steels for machine structural use with excellent machinability."

However, in the steel products disclosed in Patent Application Laid-open (Kokai) No. 2-111842, it is essential that B be incorporated into the steel so that boron nitride particles (BN) serve as nuclei for precipitation, to thereby facilitate graphitization, and thus the steel becomes susceptible to cracks when solidified. In contrast, in the method disclosed in Patent Application Laid-Open (Kokai) No. 6-279849, graphitization in steel is accelerated under the as-hot-rolled condition, through addition of Al and through limitation of O (oxygen) content in steel to a low level. This method requires more than five hours for treatment of graphitization after hot rolling, and thus is not very economical.

In contrast, a technique comprising hot working, and then quenching and tempering, followed by machining, as described in (b) above is disclosed, for example, in Patent Application Laid-open (Kokai) No. 6-212347. This involves "hot forged steel products having high fatigue strength and a method of manufacturing the same" in which steel having a specific chemical structure is quenched immediately after hot forging, followed by tempering, to thereby precipitate TiC. However, in the hot forged steel products obtained by this method, the ratio of N to Ti (N/Ti) is merely specified as less than 0.1, and therefore excellent machinability cannot always be secured. Briefly, if the content of N in steel containing 0.01 to 0.20 wt. % of Ti is merely specified such that N/Ti is less than 0.1, hard TiN may often be formed in a great amount, causing degradation of machinability, and further causing degradation of toughness.

In *TETSU-TO-HAGANE* (vol. 57 (1971) S484), it is reported that machinability may be improved through incorporation of Ti into deoxidation-adjusted free-cutting steel. However, this publication also describes that incorporation of a great amount of Ti produces a great amount of TiN, resulting in incresed wear of tools and disadvantages in terms of machinability. For example, the life of the drill to a steel having the following composition based on % by weight, C: 0.45%; Si: 0.29%; Mn: 0.78%; P: 0.017%; S: 0.041%; Al: 0.006%; N: 0.0087%; Ti: 0.228%; O: 0.004%; and Ca: 0.001%, is adversely short, and therefore, machinability of above-mentioned steel is poor. Consequently, it is concluded that machinability of steel is not improved through simple addition of Ti.

SUMMARY OF THE INVENTION

In view of the, foregoing, an object of the present invention is to provide steel products which have excellent machinability and thus are suitable for steel stocks of structural steel parts for a variety of machinery such as transportation machinery including automobiles, machinery for industrial use, construction machinery, and the like, and to provide a variety of machined structural steel parts for machinery, such as crankshafts, connecting rods, gears, and the like.

The gist of the present invention will be summarized below.

(I) A steel product which exhibits excellent machinability and which has the following chemical composition based on % by weights C: 0.05% to 0.6%; S: 0.002% to 0.2%; Ti: 0.04% to 1.0%; N: 0.008% or less; Nd: 0% to 0.1%; Se: 0% to 0.5%; Te: 0% to 0.05%; Ca: 0% to 0.01%; Pb: 0% to 0.5%; and Bi: 0% to 0.4%; wherein the maximum diameter of titanium carbosulfide contained in the steel is not greater than 10 $\mu$m and its amount expressed in the index of cleanliness of the steel is equal to or more than 0.05%.

(II) A non-heat-treated type steel product, according to (I) above, which has the following chemical composition based on % by weights C: 0.2% to 0.6%; Si: 0.05% to 1.5%; Mn: 0.01% to 2.0%; P: 0.07% or less; S: 0.01% to 0.2%; Al: 0.002% to 0.05%; Cu: 0% to 1.0%; Ni: 0% to 2.0%; Cr: 0% to 2.0%; Mo: 0% to 0.5%; V: 0% to 0.3%; Nb: 0% to 0.1%;

and the balance: Fe and unavoidable impurities, wherein at least 90% of the microstructure of the steel is constituted by ferrite and pearlite.

(III) A non-heat-treated type steel product, according to (I) above, which has the following chemical composition based on % by weight, C: 0.05% to 0.3%; Si: 0.05% to 15%; Al: 0.002% to 0.05%; Cu: 0% to 1.0%; Mo: 0% to 0.5%; V: 0% to 0.30%; Nb: 0% to 0.1%; B: 0% to 0.02%; and the balance: Fe and unavoidable impurities, wherein fn3, expressed by the following equations has a value of 2.5% to 4.5%; and at least 90% of the microstructure of the steel is constituted by bainite, or ferrite and bainite:

$$fn3=0.5Si(\%)+Mn(\%)+1.13Cr(\%)+1.98Ni(\%).$$

(IV) A heat-treated type steel product, according to (I) above, which has the following chemical composition based on % by weight, C: 0.1% to 0.6%; Si: 0.05% to 1.5%; Mn: 0.4% to 2.0%; Al: 0.002% to 0.05%; Cu: 0% to 1.0%; Ni: 0% to 2.0%; Cr: 0% to 2.0%; Mo: 0% to 0.5%; V: 0% to 0.3%; Nb: 0% to 0.1%; B: 0% to 0.02%; and the balances Fe and unavoidable impurities, wherein at least 50% of the microstructure of the steel is constituted by martensite.

(V) A machined steel part made of the steel product as described in (I) above.

(VI) A machined steel part made of the non-heat-treated type steel product as described in (II) above.

(VII) A machined steel part made of the non-heat-treated type steel product as described in (III) above.

(VIII) A machined steel part made of the heat-treated type steel product as described in (IV) above.

The expression "titanium carbosulfide" as used herein encompasses titanium sulfide.

The expression "maximum diameter (of titanium carbosulfide)" as used herein refers to "the longest diameter among the diameters of respective titanium carbosulfide entities."

The index of cleanliness of the steel is determined by "the microscopic testing method for the non-metallic inclusions in steel" prescribed in JIS G 0555, and performed by means of an optical microscope at ×400 magnification and 60 visual fields.

The term "non-heat-treated type steel product" as used herein refers to a steel product manufactured without "quenching and tempering" which are so-called "thermal refining," and includes "steel which may be used under the as-cooled condition after hot working" as well as "steel obtained through aging corresponding to tempering after hot working and cooling." The term "heat-treated type steel product" refers to steel products obtained through "quenching and tempering".

Ratios referred to in terms of microstructure denote those observed under a microscope, i.e. area percentage.

In (II) above, "at least 90% of the microstructure of the steel is constituted by ferrite and pearlite" means that the total of the respective contents of ferrite and pearlite in the microstructure where ferrite and pearlite coexist is at least 90%.

In (III) above, "at least 90% of the microstructure of the steel is constituted by bainite" means that the bainite content in the microstructure where no ferrite exists is at least 90%, and "at least 90% of the microstructure of the steel is constituted by ferrite and bainite" means that the total of the respective contents of ferrite and bainite in the microstructure where ferrite and bainite coexist is at least 90%.

In (IV) above, "at least 50% of the microstructure of the steel is constituted by martensite" means that the martensite content in the microstructure is at least 50%. In additions the above (IV) is directed to a "heat-treated type steel product" which has undergone quenching and tempering. Likewise, the above mentioned martensite refers to martensite which has undergone tempering, i.e. "tempered martensite," and will hereinafter be referred to simply as "martensite".

BEST MODE FOR CARRYING OUT THE INVENTION

The present inventors conducted various experiments to investigate the effects of the chemical composition and the microstructure of steel products on machinability and mechanical properties.

As a results the present inventors found that machinability of a steel product is improved by (a) addition of a proper amount of Ti to the steel, (b) transformation of sulfides to titanium carbosulfides for controlling inclusions in the steel, and (c) minute dispersion of the titanium carbosulfides in the steel.

The present inventors continued the studies to find the facts (d) to (p) as follows:

(d) Titanium carbosulfide is formed in steel when Ti is intentionally added to steel containing an adequate amount of S.

(e) The formation of titanium carbosulfide in the steel decreases the amount of production of MnS.

(f) If the S content in steel is constants titanium carbosulfides are superior to MnS in terms of effect of improving machinability. This is because the titanium carbosulfide has a melting point lower than that of MnS and thus achieves an increased lubrication effect on tool faces during machining.

(g) In order to cause titanium carbosulfide to fully exert its machinability-improving effect, it is important to restrict the N content to as low as 0.008% or less in order to suppress precipitation of TiN.

(h) The restriction of the N (nitrogen) content leads to a decrease in the TiN content in steel. Therefore, it becomes possible to improve, among mechanical properties, especially the toughness.

(i) In order to improve machinability by making use of titanium carbosulfides, it is important to optimize the size of titanium carbosulfides and their amounts expressed in the index of cleanliness of the steel (hereinafter referred to simply as "index of cleanliness").

(j) Titanium carbosulfide produced during steelmaking is not solubule in the steel matrix at heating temperatures for ordinary hot working or for ordinary quenching in a thermal refining process. For this reasons titanium carbosulfides exert a so-called "pinning effect" in the austenite region, which is effective in preventing the enlargement of austenite grains. Needless to say, titanium carbosulfides are not solubule in the steel matrix at heating temperatures for ordinary tempering in a thermal refining process, or hot working, or for aging process corresponding to tempering.

(k) Steel products containing at least 90% of ferrite and pearlite in the microstructure, very rarely suffers an occurrence of bend due to transformation-induced strain and residual stress.

(l) Steel containing at least 90% of bainite and ferrite exclusively, or ferrite and bainite in the microstructure, exhibits an excellent balance between strength and toughness.

(m) Steel containing at least 50% of martensite in the microstructure exhibits an extremely excellent balance between strength and toughness.

(n) In non-heat-treated type steel products, having a certain chemical composition and containing at least 90% of ferrite and pearlite in the microstructure; an excellent balance between strength and toughness can be obtained, if the steel satisfies any of the following: (1) ferrite accounts for 20% to 70% based on area percentage, (2) ferrite grain size of at least 5 according to JIS grain size number, or (3) the average lamellar spacing of pearlite is 0.2 $\mu$m or less.

(o) If the value of fn1 expressed by equation (1) below is greater than 0%, and/or the value of fn2 expressed by equation (2) below is greater than 2, the machinability-improving effect of titanium carbosulfides is improved. In additions if the value of fn2, expressed by equation (2) below, is greater than 2, the pinning effect of titanium carbosulfide is improved and excellent strength and toughness is obtained.

$$fn1=Ti(\%)-1.2S(\%) \quad (1)$$

$$fn2=Ti(\%)/S(\%) \quad (2).$$

(p) The value of fn3, expressed by equation (3) below, governs a certain relationship between the microstructure and toughness of non-heat-treated type steel which has a certain chemical composition. If this value is within a certain ranges at least 90% of the microstructure is bainite exclusively, or ferrite and bainite.

$$fn3=0.05Si(\%)+Mn(\%)+1.13Cr(\%)+1.98Ni(\%) \quad (3).$$

The present invention has been accomplished based on the above findings.

Requirements of the present invention will now be described in detail. The symbol "%" indicative of the content of each element means "% by weight."

(A) Chemical Composition of Steel Products

C:

C binds to Ti together with S to form titanium carbosulfide and to have an effect of improving machinability. Also, C is an element effective for securing strength. However, if the carbon content is less than 0.05%, these effects cannot be obtained. On the other hand, if the carbon content is in excess of 0.6%, toughness will be impaired. Therefore, the carbon content shall be from 0.05% to 0.6%.

In non-heat-treated type steel containing at least 90% of ferrite and pearlite in the microstructure of the steel (hereinafter referred to as "steel products under Condition X" for purpose of simplicity), the carbon content shall be, desirably, from 0.2% to 0.6%, more desirably, from 0.25% to 0.5%.

In non-heat-treated type steel containing at least 90% of bainite exclusively, or ferrite and bainite in the microstructure (hereinafter referred to as "steel products under Condition Y" for purpose of simplicity), the carbon content shall be, desirably, from 0.05% to 0.3%, more desirably, from 0.1% to 0.24%.

In heat-treated type steel containing at least 50% of martensite in the microstructure (hereinafter referred to as "steel products under Condition Z" for purpose of simplicity), the carbon content shall be, desirably, from 0.1% to 0.6%.

S:

S binds to Ti together with C to form titanium carbosulfide and to have an effect of improving machinability. However, if the sulfur content is less than 0.002%, the effect cannot be obtained.

Conventionally, S has been incorporated into free-cutting steel in order that the machinability is improved by forming MnS. According to the studies of the present inventors the above-mentioned machinability-improving effect of MnS relies on the effect of improving lubrication between the chips and the face of a tool during machining. To make matters worse, MnS may become large and cause a large macro-streak-flaw for steel products, resulting in a defect.

In the present invention, the machinability-improving effect of S is obtained by forming titanium carbosulfide through incorporation of adequate amounts of C and Ti. Therefore, as mentioned above, the sulfur content is required to be not less than 0.002%. By contrast, if the sulfur content is in excess of 0.2%, although no effect is provided for machinability, coarse MnS is produced in the steel again, which leads to problems such as a macro-streak-flaw. In additions since hot workability is considerably impaired, plastic working becomes difficult and toughness may be impaired. Therefore, the sulfur content shall be from 0.002% to 0.2%.

In "steel products under Condition X," the sulfur content shall be, desirably, from 0.01% to 0.2%, more desirably, from 0.02% to 0.17%.

In "steel products under Condition Y," the sulfur content shall be, desirably, from 0.005% to 0.17%.

Ti:

In the present invention, Ti is an important alloy element to control inclusions. If the titanium content is less than 0.04%; S is not fully incorporated into the titanium carbosulfide and thus improved machinability is not obtained. By contrast, if the titanium content is in excess of 1.0%, not only the cost increases as the machinability-improving effect saturates, but also the toughness and hot-workability decrease excessively. Therefore, the titanium content shall be from 0.04% to 1.0%.

In "steel products under Condition X," the titanium content shall be, desirably, from 0.08% to 0.8%.

In "steel products under Condition Y," the titanium content shall be, desirably, from 0.06% to 0.8%.

In "steel products under Condition Z," the titanium content shall be, desirably, from 0.06% to 0.8%.

N: 0.008% or less

In the present invention, it is very important to restrict the nitrogen content to a low level. Briefly, N, having strong affinity with Ti, easily binds to Ti to form TiN, thereby immobilizing Ti. Therefore, the addition of a great amount of N impedes the full exertion of the above-mentioned machinability-improving effect of titanium carbosulfide. Moreover, coarse TiN impairs toughness and machinability. Therefore, the nitrogen content shall be 0.008% or less. In order to enhance the effect of titanium carbosulfide, the upper limit of the nitrogen content shall be, desirably, 0.006%.

Nd:

Nd may be omitted. Nd, if added, becomes $Nd_2S_3$ serving as a chip breaker to have an effect of improving machinability. Further, since $Nd_2S_3$ is finely produced in molten steel in a dispersing manner at relatively high temperatures, the growth of austenite grains, due to heat, is restricted during hot working or quenching in the subsequent process and thus the microstructure becomes fine, resulting in high strength and toughness of steel. To reliably obtain this effect, the neodymium content shall be, desirably, not less than 0.005%. However, if the neodymium content is in excess of 0.1% $Nd_2S_3$becomes coarse and could impair toughness. Therefore, the neodymium content shall be from 0% to 0.1%. Desirably, the upper limit of the neodymium content shall be 0.08%.

Se:

Se may be omitted. Se, if added, has an effect of further improving the machinability of steel. To reliably obtain this effect, the selenium content shall be, desirably, not less than 0.1%. However, when the selenium content is in excess of 0.5%, not only the above-mentioned effect saturates, but also fatigue strength and/or toughness decrease as coarse inclusions are produced. Therefore, the selenium content shall be from 0% to 0.5%.

Te:

Te may be omitted. Te, if added, has an effect of further improving machinability of steel. To reliably obtain this effect the tellurium content shall be, desirably not less than 0.005%. However when the tellurium content is in excess of 0.05%, not only the above-mentioned effect saturates, but also fatigue strength and/or toughness of the steel decrease as coarse inclusions are produced. Further, addition of a great amount of Te leads to decreased hot-workability. Specifically, if the tellurium content is in excess of 0.05%, scratches are formed in the surfaces of steel products which have undergone hot working. Therefore, the tellurium content shall be from 0% to 0.05%.

Ca:

Ca may be omitted. Ca, if added, has an effect of remarkably improving machinability of steel. To reliably obtain this effect, the calcium content shall be, desirably not less than 0.001%. However, when the calcium content is in excess of 0.01%, not only the above-mentioned effect saturates, but also fatigue strength and/or toughness decrease as coarse inclusions are produced. Therefore, the calcium content shall be from 0% to 0.01%.

Pb:

Pb may be omitted. Pb, if added, has an effect of further improving the machinability of steel. To reliably obtain this effect, the lead content shall be, desirably, not less than 0.05%. However, when the lead content is in excess of 0.5%, not only the above-mentioned effect saturates, but also fatigue strength and/or toughness decrease as coarse inclusions are produced. Further, addition of a great amount of Pb leads to decreased hot-workability. Specifically, if the lead content is in excess of 0.5%, scratches are formed in the surfaces of steel products which have undergone hot working. Therefore, the lead content shall be from 0% to 0.5%.

Bi:

Bi may be omitted. Bi, if added, has an effect of further improving the machinability of steel. To reliably obtain this effects the bismuth content shall be, desirably, not less than 0.05%. However, when the bismuth content is in excess of 0.4%, not only the above-mentioned effect saturates, but also fatigue strength and/or toughness decrease as coarse inclusions are produced. Further, addition of a great amount of Bi leads to decreased hot-workability, resulting in scratches which are formed in the surfaces of steel products which have undergone hot working. Therefore, the bismuth content shall be from 0% to 0.4%.

As far as machinability is concerned, no particular restriction is imposed on any elements other than C, S, Ti, N, Nd, Se, Te, Ca, Pb and Bi used for "steel products excellent in machinability" in the present invention. However, there are often requirements for other properties in addition to machinability. These requirements include rare occurrence of bend or residual stress due to transformation-induced strain, excellent balance between strength and toughness, and so on. In such cases, the requirements are satisfied by determining the chemical composition of the above-mentioned elements other than C, S, Ti, N, Nd, Se, Te, Ca, Pb and Bi, in relation to the microstructures of steel products.

The chemical composition of the elements other than C, S, Ti, N, Nd, Se, Te, Ca, Pb and Bi will next be described for each case of the above-mentioned "steel products under Condition X", "steel products under Condition Y" and "steel products under Condition Z".

(A-1) In the case of non-heat-treated type steel products containing at least 90% of ferrite and pearlite in the microstructure ("steel products under Condition X")

Si:

Si is an element effective for deoxidizing a steel and for strengthening the ferrite phase. Further, the increased silicon content improves lubrication on the surface of the chips during machining and thus the service life of the tool is extended, resulting in improved machinability. However, if the silicon content is less than 0.05%, the effect of the addition is insignificant, whereas if the silicon content is in excess of 1.5%, not only the above-mentioned effect saturates, but also toughness is impaired. Therefore, the silicon content shall be, desirably, from 0.05% to 1.5%, more desirably, from 0.3% to 1.3%, most desirably, from 0.5% to 1.3%.

Mn:

Mn is an element effective for improving fatigue strength through solid-solution strengthening. However, if the manganese content is less than 0.1%, the effect is difficult to obtains whereas if the manganese content is in excess of 2.0%, in the case of "steel products under Condition X", endurance ratio (fatigue strength/tensile strength) and yield ratio (yield strength/tensile strength) may be impaired. Therefore, the manganese content shall be, desirably, from 0.1% to 2.0%, more desirably, from 0.4% to 2.0%, and most desirably, from 0.5% to 1.7%.

P:

P may be intentionally added. This is because P has an effect of improving tensile strength and fatigue strength in "steel products under Condition X". In order to reliably obtain this effect, the phosphorus content shall be, desirably, not less than 0.01%. However, if the phosphorus content is in excess of 0.07%, toughness decreases remarkably and hot-workability is impaired. Therefore, the phosphorus content shall be, desirably, not greater than 0.07%. If P is added intentionally, the phosphorus content shall be, desirably, from 0.015% to 0.05%.

Al:

Al is an element effective for deoxidizing a steel. However, if the aluminum content is less than 0.002%, the desired effect is difficult to obtain, whereas if the aluminum content is in excess of 0.05%, the effect is saturated and machinability is also impaired. Therefore, the aluminum content shall be, desirably, from 0.002% to 0.05%, more desirably, from 0.005% to 0.03%.

Cu:

Cu may be omitted. Cue if added, has an effect of improving strengths especially fatigue strength of a steel, through precipitation strengthening. To reliably obtain this effects the copper content shall be, desirably, not less than 0.2%. However, when the copper content is in excess of 1.0%, hot-workability is impaired, and moreover as precipitates become coarse, the above-mentioned effect saturates or decreases. In addition, the cost increases. Therefore, the copper content shall be, desirably, from 0% to 1.0%.

Ni:

Ni may be omitted. Ni, if added, has an effect of improving strength. To reliably obtain this effects the nickel content shall be, desirably, not less than 0.02%. However, when the nickel content is in excess of 2.0%, this effect saturates and thus the cost increases. Therefore, the nickel content shall be, desirably, from 0% to 2.0%.

Cr:

Cr may be omitted. Cr, if added, has an effect of improving fatigue strength through solid-solution strengthening. To reliably obtain this effect, the chromium content shall be, desirably, not less than 0.02%. However, if the chromium content is in excess of 2.0%, in "steel products under Condition X", endurance ratio and yield ratio may be impaired. Therefore, the chromium content shall be, desirably, from 0% to 2.0%. In the case where Cr is added, the chromium content shall be, desirably, from 0.05% to 1.5%.

Mo:

Mo may be omitted. Mo, if added, has an effect of improving strength, especially fatigue strength of a steel, since the microstructure composed of ferrite and pearlite becomes fine. To reliably obtain this effect, the molybdenum content shall be, desirably, not less than 0.05%. However, when the molybdenum content is in excess of 0.5%, the microstructure through hot working becomes abnormally coarse, resulting in lowered fatigue strength. For that reason, the molybdenum content shall be, desirably, from 0% to 0.5%.

V:

V may be omitted. V, if added, has an effect of improving strength, especially fatigue strength of a steel, since V precipitates as fine nitride or carbonitride. To reliably obtain this effect, the vanadium content shall be, desirably, not less than 0.05%. However, when the vanadium content is in excess of 0.3%, the precipitates become coarse, resulting in saturation, or even impairment, of the above-mentioned effect. In addition, the material costs increase. Therefore, the vanadium content shall be, desirably, from 0% to 0.3%.

Nb:

Nb may be omitted. Nb, if added, has an effect of preventing coarsening of austenite grains, to thereby enhance strength, especially fatigue strength of a steel, since Nb precipitates as fine nitride or carbonitride. To reliably obtain this effect, the niobium content shall be, desirably, not less than 0.005%. However, when the niobium content is in excess of 0.1%, not only does the above-mentioned effect saturate, but also coarse hard carbonitride may be produced to damage tools, resulting in lowered machinability. Therefore, the niobium content shall be, desirably, from 0% to 0.1%. More desirably, the upper limit of niobium content shall be 0.05%.

fn1, fn2:

As mentioned above, if the value of fn1 expressed by the equation (1) is greater than 0%, and/or the value of fn2 expressed by the equation (2) is greater than 2, the machinability-improving effect of titanium carbosulfides is enhanced. In addition, if the value of fn2, expressed by the equation (2), is greater than 2, the pinning effect of titanium carbosulfides is enhanced, to thereby improve tensile strength and fatigue strength. Therefore, it is desired that the value of fn1 shall be greater than 0%, or alternatively, the value of fn2 shall be greater than 2. No particular limitation is imposed on the upper limits of the values of fn1 and fn2, and they may be determined so as to comply with compositional requirements.

Incidentally, O (oxygen) as an impurity element forms hard oxide-type inclusions, by which the machine tool may be damaged, resulting in lowered machinability. In particular, the oxygen content in excess of 0.015% may considerably impair machinability. Consequently, in order to maintain excellent machinability, the amount of O as an impurity element shall be, desirably, 0.015% or less. More desirably, the oxygen content shall be 0.01% or less.

(A-2) In the case of non-heat-treated type steel products in which bainite or a combination of ferrite and bainite accounts for at least 90% of the microstructure of the steel ("steel products under Condition Y")

Si:

Si has an effect of deoxidizing a steel and improving hardenability. Furthermore, in "steel products under Condition Y", the increased silicon content improves lubrication on the surface of the chips during machining and thus the service life of the tool is extended, resulting in improved machinability. However, when the silicon content is less than 0.05%, the above-mentioned effects are poor, whereas if the silicon content is in excess of 1.5%, not only do the above-mentioned effects saturate, but also toughness is impaired. Therefore, the silicon content shall be, desirably, from 0.05% to 1.5%. More desirably, the silicon content shall be from 0.5% to 1.3%.

Al:

Al is an element having powerful deoxidizing effect on a steel. To secure this effects the aluminum content shall be, desirably, not less than 0.002%. However, when the aluminum content is in excess of 0.05%, the effect saturates and the only result is increased cost. Therefore, the aluminum content shall be, desirably from 0.002% to 0.05%, more desirably from 0.005% to 0.004%.

Cu:

Cu may be omitted. Cu, if added, has an effect of improving machinability as well as strength of the steel without lowering toughness To reliably obtain this effect, the copper content shall be, desirably, not less than 0.2%. However, when the copper content is in excess of 1.0%, not only is hot workability impaired, but also precipitates may become coarse, resulting in saturation of the above-mentioned effect or lowered toughness. In addition, the cost increases. Therefore, the copper content shall be, desirably, from 0% to 10%.

Mo:

Mo may be omitted. Mo, if added, has an effect of improving hardenability and strength of a steel by rendering the microstructure of the steel very fine. To reliably obtain this effect, the molybdenum content shall be, desirably, not less than 0.05%. However, when the molybdenum content is in excess of 0.5%, the microstructure obtained through hot working becomes abnormally coarse, resulting in lowered toughness. For this reason, the molybdenum content shall be, desirably, from 0% to 0.5%.

V:

V may be omitted. V, if added, has an effect of improving strength, since V precipitates as fine nitride or carbonitride, and moreover, has an effect of improving lubrication on the surface of the chips during machining. To reliably obtain these effects, the vanadium content shall be, desirably, not less than 0.05%. However, when the vanadium content is in excess of 0.30%, as the precipitates become coarse, the above-mentioned effect may saturate or toughness may decrease. In addition, the cost increases. Therefore, the vanadium content shall be, desirably, from 0% to 0.30%.

Nb:

Nb may be omitted. Nb, if added, has an effect of preventing coarsening of austenite grains and improving strength and toughness of the steel, since Nb precipitates as fine nitride or carbonitride. To reliably obtain this effect, the niobium content shall be, desirably, not less than 0.005%. However, when the niobium content is in excess of 0.1%, not only does the above-mentioned effect saturate, but also coarse hard carbonitride may be produced to damage tools, inviting degraded machinability. Therefore, the niobium content shall be, desirably, from 0% to 0.1%.

B:

B may be omitted. B, if added, has an effect of improving strength and toughness of a steel due to increased hardenability. To secure this effect, the boron content shall bee desirably, not less than 0.0003%. However, when the boron content is in excess of 0.02%, not only may the above-mentioned effect saturate, but also toughness may decrease. Therefore, the boron content shall be, desirably, from 0% to 0.02%.

fn3:

As described above, the value of fn3, expressed by the aforementioned equation (3), is correlated to the microstructure and toughness of a non-heat-treated type steel product having a certain chemical composition. When the value is in the range of 2.5–4.5%, the primary microstructure of the non-heat-treated type steel product comes to be bainite, or a combination of ferrite and bainite, thus achieving well-balanced strength and toughness.

Si, Mn, Cr and Ni, which form the terms of the equation for fn3, have the effect of enhancing hardenability of the steel. When the value of fn3 is less than 2.5%, intended improvement in hardenability cannot be obtained, with toughness being sometimes degraded. In contrasts the values of fn3 in excess of 4.5% result in excessive hardenability, which may in turn degrade toughness. Therefore, it is desired that the value of fn3 expressed by the equation (3) shall be from 2.5% to 4.5%. In this connection, the contents of the respective elements other than Si are not particularly limited, so long as the above-mentioned fn3 falls within the range of 2.5–4.5%. However, desirably, Mn, Cr and Ni shall be contained in amounts of 0.4–3.5%, 3.0% or less, and 2.0% or less, respectively.

In the case of "steel products under Condition Y", as mentioned above, the machinability-improving effect of titanium carbosulfides is enhanced when the value of fn1 expressed by the equation (1) is greater than 0%, and/or the value of fn2 expressed by the equation (2) is greater than 2. Furthermore, when the value of fn2, expressed by the equation (2), is greater than 2, the pinning effect of titanium carbosulfides increases as well, to thereby improve tensile strength and fatigue strength. Therefore, it is desired that the value of fn1 shall be greater than 0%, or alternatively, the value of fn2 shall be greater than 2. The upper limits of the values of fn1 and fn2 are not particularly limited, and they may be determined based on compositional requirements.

Incidentally, O (oxygen) as an impurity element forms hard oxide-type inclusions, by which the machine tool may be damaged, resulting in lowered machinability. In particular, the oxygen content in excess of 0.015% may invite significant degradation in machinability. Therefore, even in the case of "steel products under Condition Y", in order to maintain excellent machinability, the amount of O as an impurity element shall be, desirably, 0.015% or less. More desirably, the oxygen content shall be 0.01% or less.

Moreover, from the viewpoint of securing toughness of the steel, phosphorus (P) as an impurity element shall be, desirably, suppressed to 0.05% or less.

(A-3) In the case of heat-treated type steel products in which martensite accounts for at least 50% of the microstructure of the steel ("steel products under Condition Z")

Si:

Si has an effect of deoxidizing a steel and improving hardenability. Furthermore, in the case of "steel products under Condition Z", increased silicon content improves lubrication on the surface of the chips during machining and thus the service life of the tool is extended, resulting in improved machinability. However, if the silicon content is less than 0.05%, the above-mentioned effects are poor, whereas if the silicon content is in excess of 1.5%, not only the above-mentioned effects saturate, but also toughness is impaired. Therefore, the silicon content shall be, desirably, from 0.05% to 1.5%.

Mn:

Mn improves hardenability of a steel and improves fatigue strength through solid-solution strengthening. However, if the manganese content is less than 0.4%, these effects are difficult to obtain, whereas if the manganese content is in excess of 2.0%, not merely these effects saturate, but also the steel becomes excessively hard to cause degradation in toughness. Accordingly, the manganese content shall be, desirably, from 0.4% to 2.0%.

Al:

Al is an element having strong deoxidizing effect on a steel. In order to secure this effect, the aluminum content shall be, desirably, not less than 0.002%. However, if the aluminum content is in excess of 0.05%, the effect saturates and the only result is increased costs. Therefore, the aluminum content shall be, desirably, from 0.002% to 0.05%, more desirably, from 0.005% to 0.04%.

Cu:

Cu may be omitted. Cu, if added, has an effect of improving strength without lowering toughness, and in addition, enhances machinability. To secure these effects, the copper content shall be, desirably, not less than 0.2%. However, when the copper content is in excess of 1.0%, hot workability is impaired and precipitates become coarse, resulting in saturating the above-mentioned effect or even impairing the effects In addition, the cost increases. Therefore, the copper content shall be, desirably, from 0% to 1.0%.

Ni:

Ni may be omitted. Ni, if added, has an effect of improving hardenability of a steel. To secure this effect, the nickel content shall be, desirably, not less than 0.02%. However, when the nickel content is in excess of 2.0%, this effect saturates and thus the cost increases. Therefore, the nickel content shall be, desirably, from 0% to 2.0%.

Cr:

Cr may be omitted. Cr, if added, has an effect of enhancing hardenability of a steel, and also improves fatigue strength through solid-solution strengthening. To reliably obtain these effects, the chromium content shall be, desirably, not less than 0.03%. However, when the chromium content is in excess of 2.0% not only do the above-mentioned effects saturate, but also the steel becomes excessively hard, resulting in lowered toughness. Therefore, the chromium content shall be, desirably, from 0% to 2.0%.

Mo:

Mo may be omitted. Mo, if added, has an effect of improving hardenability of a steel. To reliably obtain this effect, the molybdenum content shall be, desirably, not less than 0.05%. However, when the molybdenum content is in excess of 0.5%, not only does the above-mentioned effect saturate but also the steel becomes excessively hard, resulting in lowered toughness and increased cost. For this reason, the molybdenum content shall be, desirably, from 0% to 0.5%.

V:

V may be omitted. V, if added, has an effect of improving strength, especially fatigue strength of a steel, since V precipitates as fine nitride or carbonitride. To reliably obtain this effect, the vanadium content shall be, desirably, not less than 0.05%. However, when the vanadium content is in excess of 0.3%, the precipitates become coarse, resulting in saturation, or even impairment, of the above-mentioned effect. In addition, the material costs increase. Therefore, the vanadium content shall be, desirably, from 0% to 0.3%.

Nb:

Nb may be omitted. Nb, if added, has an effect of preventing coarsening of austenite grains, to thereby enhance strength, especially fatigue strength and toughness of a steel, since Nb precipitates as fine nitride or carbonitride. To reliably obtain these effects, the niobium content shall be, desirably, not less than 0.005%. However, when the niobium content is in excess of 0.1%, not only do the above-mentioned effects saturate, but also coarse hard carbonitride may be produced to damage tools, resulting in lowered machinability. Therefore, the niobium content shall be, desirably, from 0% to 0.1%. More desirably, the upper limit of niobium content shall be 0.05%.

B:

B may be omitted. B, if added, has an effect of improving strength and toughness of a steel due to increased hardenability. To secure this effect, the boron content shall be, desirably, not less than 0.0003%. However, when the boron content is in excess of 0.02%, not only may the above-mentioned effect saturate, but also toughness may be lowered. Therefore, the boron content shall be, desirably, from 0% to 0.02%.

fn1, fn2:

Also in "steel products under Condition Z", as aforementioned, if the value of fn1 expressed by the equation (1) is greater than 0%, and/or the value of fn2 expressed by the equation (2) is greater than 2, the machinability-improving effect of titanium carbosulfides is enhanced. In additions if the value of fn2, expressed by the equation (2), is greater than 2, the pinning effect of titanium carbosulfides is enhanced, to thereby improve tensile strength and fatigue strength. Therefore, it is desired that the value of fn1 shall be greater than 0%, or alternatively, the value of fn2 shall be greater than 2. No particular limitation is imposed on the upper limits of the values of fn1 and fn2, and they may be determined so as to comply with compositional requirements.

Incidentally, O (oxygen) as an impurity element forms hard oxide-type inclusions, by which the machine tool may be damaged, resulting in lowered machinability. In particular, the oxygen content in excess of 0.015% may considerably impair machinability Consequently, also in "steel products under Condition Z", in order to maintain excellent machinability, the amount of O as an impurity element shall be, desirably, 0.015% or less. More desirably, the oxygen content shall be 0.01% or less.

Moreover, from the point of securing toughness of the steel, P (phosphorus) as an impurity element shall be, desirably, suppressed to 0.05% or less.

(B) The size and the index of cleanliness in terms of titanium carbosulfides

In order to improve machinability of steel products having chemical compositions described in (A) above through use of titanium carbosulfides, it is important that the size and the index of cleanliness in terms of titanium carbosulfides be optimized. As described herein above, the expression "titanium carbosulfides" encompasses titanium sulfides.

In the case in which the amount expressed by the index of cleanliness in terms of titanium carbosulfide having a maximum diameter of not more than 10 $\mu$m is less than 0.05%, titanium carbosulfides cannot exhibit their machinability-improving effect. The above-mentioned index of cleanliness shall be, desirably, not less than 0.08%. When the above-mentioned index of cleanliness in terms of titanium carbosulfides is excessively large, fatigue strength may sometimes be degraded. Therefore, the upper limit of the above-mentioned index of cleanliness in terms of titanium carbosulfides shall be, desirably, approximately 2.0%.

The reason why the size of titanium carbosulfide is limited—i.e., why the maximum diameter of titanium carbosulfide is set to 10 $\mu$m—is that sizes in excess of 10 $\mu$m reduce fatigue strength and/or toughness. Desirably, the maximum diameter of titanium carbosulfide shall be 7 $\mu$m. However, in view that too small a maximum diameter of titanium carbosulfides provides insignificant machinability-improving effect, the lower limit of the maximum diameter of titanium carbosulfide shall be, desirably, about 0.5 $\mu$m.

The form of titanium carbosulfide is basically determined by the amounts of Ti, S and N contained in the steel. In order to bring the size and the index of cleanliness in terms of titanium carbosulfides within the predetermined ranges, it is important to prevent overproduction of titanium oxides. To this end, according to a preferred steelmaking process, steel is first sufficiently deoxidized with Si and Al, then Ti is added; since in some cases, satisfaction of the compositional requirements for the steel mentioned in (A) is not sufficient by itself.

Titanium carbosulfides can be discerned from other inclusions based on their color and shape through mirror-like polishing of test pieces cut from steel products and through observation of the polished surface under an optical microscope at ×400 or higher multiplication. That is, titanium carbosulfides have a very pale gray color and a granular (spherical) shape corresponding to B-type inclusions according to JIS (Japanese Industrial Standards). Detailed determination of titanium carbosulfides may also be performed through observation of the aforementioned mirror-like-polished surface under an electron microscope equipped with an analytical device such as EDX (energy dispersive X-ray spectrometer).

The index of cleanliness in terms of titanium carbosulfides is determined as described hereinabove; i.e., in accordance with "the microscopic testing method for the non-metallic inclusions in steel" prescribed in JIS G 0555, and performed by means of an optical microscope at ×400 magnification and 60 visual fields.

(C) Microstructure of steel products

So far as machinability is concerned, "steel products excellent in machinability" of the present invention can be obtained by simply prescribing the amounts of C, S, Ti, N, Nd, Se, Te, Ca, Pb and Bi as described in (A) above and also prescribing the size and the index of cleanliness in terms of titanium carbosulfide as described in (B) above. However, when the steel is required to meet other characteristics in addition to machinability, the microstructure of steel products may be additionally prescribed as well.

First, in the case in which not less than 90% of the microstructure of a steel product is constituted by ferrite and pearlite, occurrence of bend and residual stress attributed to transformation-induced strain does not raise a critical issue. Therefore, if not less than 90% of the microstructure of a steel product is made to be constituted by ferrite and pearlite, reformation (straightening step) as a finish step can be eliminated, leading to reduced costs. Moreover, in the case in which the steel product is a non-heat-treated type steel product, there can be saved considerable energy and cost which would otherwise be required for thermal refining.

In order to make not less than 90% of the microstructure of a non-heat-treated type steel product to be constituted by ferrite and pearlite, a semi-finished product having a chemical composition described in (II) above may first be heated to 1050–1300° C., then subjected to hot working such as hot forging to finish at a temperature not lower than 900° C., and subsequently subjected to air cooling or atmospheric cooling at a cooling rate of not more than 60° C./min for at least a period until the temperature reaches 500° C. In the present specifications the expression "cooling rate" refers to the cooling rate as measured on the surface of the steel product.

In the case of non-heat-treated type steel products having the above microstructure, well-balanced excellent strength and toughness can be obtained when at least one of the following conditions are met: ferrite accounts for 20–70% in terms of the area percentages ferrite grain size is 5 or more as expressed by the JIS grain size number; the average lamellar spacing of pearlite is 0.2 $\mu$m or less.

Next, in the case of steel products in which not less than 90% of the microstructure is constituted by bainite or a combination of ferrite and bainite, well-balanced strength and toughness are appreciable. Therefore, if well-balanced strength and toughness are required, not less than 90% of the microstructure of a steel product should be made to be constituted by bainite, or a combination of ferrite and bainite. Moreover, in the case in which the steel product is a non-heat-treated type steel product, there can be saved considerable energy and cost which would otherwise be required for thermal refining.

In order to make not less than 90% of the microstructure of a non-heat-treated type steel product to be constituted by bainite, or by a combination of ferrite and bainite, a semi-finished product having a chemical composition described in (III) above may first be heated to 1050–1300° C., then subjected to hot working such as hot forging to finish at a temperature not lower than 900° C., and subsequently subjected to air cooling or atmospheric cooling at a cooling rate of not more than 60° C./min for at least a period until the temperature reaches 300° C.

In the case of non-heat-treated type steel products, the greater the working ratio of the steel products during hot working, the finer the microstructure of the steel products, thus exhibiting a better balance between strength and toughness. Therefore, the working ratio during hot working shall be, desirably, not less than 1.5. The expression "working ratio" is used to refer to the ratio $A_0/A$ where $A_0$ represents a sectional area before working and A represents a sectional area after working.

When the prior austenite grain size in the microstructure is 4 or more as expressed by the JIS grain size number, a non-heat-treated type steel product in which not less than 90% of the microstructure is constituted by bainite or a combination of ferrite and bainite (i.e., a "steel product under Condition Y") can be consistently imparted with well-balanced strength and toughness. As used herein, the expression "prior austenite grains" in a non-heat-treated type steel product refers to austenite grains right before bainite or ferrite is generated therefrom as a result of transformation under heat and hot working. Prior austenite grains in a non-heat-treated type steel product in which not less than 90% of the microstructure is constituted by bainite or a combination of ferrite and bainite can be readily determined through corrosion with nital and observation under an optical microscope.

When aging treatment is performed by the application of heat under conditions of 200–700° C. for 20–150 minutes following hot working and cooling, a particularly excellent balance between strength and toughness can be obtained.

Finally, in the case of a steel product in which not less than 50% of the microstructure is constituted by martensite, balance between strength and toughness becomes more excellent. Therefore, when more excellent balance between strength and toughness is required, not less than 50% of the microstructure should be made to be constituted by martensite. Moreover, in the case in which the steel product is a heat-treated type steel product, remarkably excellent balance between strength and toughness can be obtained.

In order to make not less than 50% of the microstructure of a heat-treated type steel product to be constituted by martensite, a semi-finished product having a chemical composition described in (IV) above may be treated as follows. Briefly, the semi-finished product is first heated to 1050–1300° C., then subjected to hot working such as hot forging at a working ratio of 1.5 or more and to finishing at a temperature not lower than 900° C. Subsequently the finished steel material is subjected to air cooling or atmospheric cooling at a cooling rate of not more than 60° C./min for at least a period until the temperature reaches 300° C. Subsequently, the steel product is heated to a temperature range of 800–950° C., maintained for 20–150 minutes, then quenched by use of a cooling medium such as water or oils followed by heating to 400–700° C., maintained for 20–150 minutes, and then subjected to air cooling, atmospheric cooling, or alternatively, depending on cases, water cooling or oil cooling followed by tempering. The quenching treatment may be performed by way of so-called "direct quenching," in which steel products are quenched directly from the austenite region or austenite-ferrite dual phase region after hot working.

In order for a heat-treated type steel product to secure remarkably excellent strength and toughness in a well balanced manner, it is preferred that not less than 80% of the microstructure be made martensite. The remaining portion of the microstructure other than martensite is constituted by microstructure resulting from tempering of ferrite, pearlite or bainite in the case in which an austenite region undergoes quenching, microstructure resulting from tempering of ferrite in the case in which an austenite-ferrite dual-phase region undergoes quenching, or microstructure resulting from temperering of austenite which has remained untransformed even when quenching was performed (so-called retained austenite). Substantially 100% of the microstructure may represent martensite.

When the prior austenite grain size is not less than 5 according to the JIS grain size number, a heat-treated type steel product in which not less than 50% of the microstructure is constituted by martensite (i.e., a "steel product under Condition Z") can be consistently imparted with extremely well-balanced strength and toughness. As used herein, the expression "prior austenite grains" in a heat-treated type steel product refers to austenite grains right before being subjected to quenching. Prior austenite grains in a heat-treated type steel product in which not less than 50% of the microstructure is constituted by martensite can be readily identified as follows, for example. A steel product is quenched or is quenched and then tempered, and a sample steel piece is cut out. The test piece is etched with aqueous solution of picric acid to which a surfactant has been added. The etched surface of the test piece is observed under an optical microscope.

EXAMPLES

The present invention is described concretely using examples, which should not be construed as limiting the present invention thereto.

Example 1

Steels having chemical compositions shown in Tables 1 to 4 were manufactured through a melting process in a 150 kg vacuum melting furnace or a 3-ton vacuum melting furnace. Steels 1, 6, and 36 to 40 were manufactured through a melting process in the 3-ton vacuum melting furnace, and other steels were manufactured through a melting process in the 150 kg vacuum melting furnace. In order to prevent the generation of titanium oxides, all steels other than steels 36 and 38 underwent adjustment of the size and the index of cleanliness of titanium carbosulfide. This adjustment was carried out by adding Ti, after various elements had been added, subsequent to sufficient deoxidization with Si and Al. For steels 36 and 38, Ti was added to a molten steel during deoxidation with Si and Al.

Steels 1 to 36 in Tables 1 to 3 are examples of the present invention, and contain each component element in an amount falling in a range specified by the present invention. In contrast, steels 37 to 46 in Table 4 are comparative examples, in which any of component elements falls outside a range specified by the present invention.

TABLE 1

| | Chemical composition (percent by weight) Balance: Fe and unavoidable impurities | | | | | | | | | | | |
|---|---|---|---|---|---|---|---|---|---|---|---|---|
| Steel | C | Si | Mn | P | S | Ti | Al | N | Cu | Ni | Cr | Mo |
| 1 | 0.48 | 0.47 | 0.85 | 0.020 | 0.055 | 0.09 | 0.020 | 0.0028 | — | — | 0.05 | — |
| 2 | 0.23 | 0.21 | 1.60 | 0.020 | 0.012 | 0.06 | 0.020 | 0.0015 | — | — | 0.50 | — |
| 3 | 0.37 | 0.21 | 1.01 | 0.020 | 0.157 | 0.81 | 0.019 | 0.0021 | — | — | 0.22 | — |
| 4 | 0.47 | 0.43 | 0.83 | 0.020 | 0.012 | 0.16 | 0.018 | 0.0019 | — | — | — | — |
| 5 | 0.39 | 0.11 | 0.98 | 0.020 | 0.114 | 0.40 | 0.021 | 0.0034 | 0.02 | — | — | — |
| 6 | 0.27 | 0.23 | 0.78 | 0.019 | 0.161 | 0.86 | 0.021 | 0.0023 | — | — | 0.44 | 0.02 |
| 7 | 0.41 | 0.70 | 0.87 | 0.019 | 0.063 | 0.20 | 0.021 | 0.0020 | — | 0.15 | — | 0.13 |
| 8 | 0.30 | 1.52 | 0.76 | 0.018 | 0.050 | 0.66 | 0.020 | 0.0013 | — | — | — | — |
| 9 | 0.23 | 0.48 | 1.86 | 0.019 | 0.069 | 0.24 | 0.021 | 0.0012 | — | — | 0.27 | — |
| 10 | 0.45 | 0.04 | 1.14 | 0.020 | 0.010 | 0.61 | 0.021 | 0.0034 | — | — | | — |
| 11 | 0.23 | 0.80 | 1.02 | 0.020 | 0.146 | 0.22 | 0.021 | 0.0038 | — | — | 1.15 | 0.05 |
| 12 | 0.25 | 0.01 | 2.16 | 0.019 | 0.015 | 0.56 | 0.020 | 0.0038 | 0.02 | — | — | — |

| | Chemical composition (percent by weight) Balance: Fe and unavoidable impurities | | | | | | | | | | | |
|---|---|---|---|---|---|---|---|---|---|---|---|---|
| Steel | V | Nb | B | Nd | Se | Te | Ca | Pb | Bi | fn1 | fn2 | fn3 |
| 1 | — | — | — | — | — | — | — | — | — | 0.02 | 1.64 | 1.14 |
| 2 | — | — | — | 0.045 | — | — | — | — | — | 0.05 | 5.00 | 2.27 |
| 3 | 0.08 | — | — | — | 0.17 | — | — | — | — | 0.62 | 5.16 | 1.36 |
| 4 | — | 0.03 | — | — | — | 0.02 | — | — | — | 0.15 | 13.2 | 1.05 |
| 5 | 0.09 | — | — | — | — | — | 0.003 | — | — | 0.26 | 3.51 | 1.04 |
| 6 | — | — | 0.0003 | — | — | — | — | 0.15 | — | 0.67 | 5.34 | 2.52 |
| 7 | 0.04 | — | — | — | — | — | — | — | 0.12 | 0.12 | 3.19 | 1.52 |
| 8 | 0.06 | — | — | 0.037 | — | — | — | — | — | 0.60 | 13.3 | 1.52 |
| 9 | — | — | — | — | — | — | — | — | — | 0.16 | 3.45 | 2.90 |
| 10 | — | 0.04 | — | — | — | — | — | — | — | 0.60 | 59.4 | 1.16 |
| 11 | — | — | — | — | — | — | 0.003 | 0.12 | — | 0.04 | 1.51 | 2.72 |
| 12 | — | — | — | — | — | — | — | — | 0.09 | 0.54 | 38.4 | 2.17 |

fn1 = Ti (%) − 1.2S (%),
fn2 = Ti (%)/S (%)
fn3 = 0.5 Si (%) + Mn (%) + 1.13 Cr (%) + 1.9 SNi (%)

TABLE 2

| | Chemical composition (percent by weight) Balance: Fe and unavoidable impurities | | | | | | | | | | | |
|---|---|---|---|---|---|---|---|---|---|---|---|---|
| Steel | C | Si | Mn | P | S | Ti | Al | N | Cu | Ni | Cr | Mo |
| 13 | 0.39 | 0.45 | 1.40 | 0.021 | 0.058 | 0.13 | 0.021 | 0.0022 | — | — | — | 0.07 |
| 14 | 0.23 | 0.50 | 1.20 | 0.019 | 0.098 | 0.63 | 0.021 | 0.0015 | — | — | — | — |
| 15 | 0.20 | 1.61 | 0.74 | 0.018 | 0.012 | 0.30 | 0.020 | 0.0032 | — | — | 0.13 | — |
| 16 | 0.46 | 0.03 | 1.10 | 0.039 | 0.047 | 0.18 | 0.021 | 0.0030 | — | — | 0.08 | 0.54 |
| 17 | 0.31 | 0.20 | 2.05 | 0.019 | 0.161 | 0.37 | 0.019 | 0.0036 | — | — | — | — |
| 18 | 0.47 | 0.47 | 0.87 | 0.020 | 0.053 | 0.32 | 0.019 | 0.0039 | — | — | 0.06 | — |
| 19 | 0.23 | 0.08 | 0.03 | 0.020 | 0.070 | 0.48 | 0.018 | 0.0014 | — | 0.02 | 2.11 | — |
| 20 | 0.47 | 0.47 | 1.20 | 0.019 | 0.169 | 0.43 | 0.019 | 0.0039 | 1.10 | — | 0.41 | — |
| 21 | 0.21 | 0.50 | 1.20 | 0.019 | 0.140 | 0.23 | 0.021 | 0.0035 | — | — | — | — |
| 22 | 0.24 | 0.40 | 1.50 | 0.021 | 0.101 | 0.22 | 0.020 | 0.0026 | — | — | 0.50 | 0.08 |
| 23 | 0.32 | 0.03 | 1.80 | 0.019 | 0.071 | 0.73 | 0.021 | 0.0039 | 0.20 | — | — | — |
| 24 | 0.15 | 0.21 | 2.10 | 0.018 | 0.098 | 0.88 | 0.018 | 0.0023 | — | 0.02 | 0.28 | — |

| | Chemical composition (percent by weight) Balance: Fe and unavoidable impurities | | | | | | | | | | | |
|---|---|---|---|---|---|---|---|---|---|---|---|---|
| Steel | V | Nb | B | Nd | Se | Te | Ca | Pb | Bi | fn1 | fn2 | fn3 |
| — | 0.04 | — | — | 0.20 | — | — | — | — | 0.06 | 2.19 | 1.63 | |
| 0.13 | — | — | — | — | 0.03 | — | — | 0.51 | 6.41 | 1.45 | | |
| 0.08 | — | — | — | — | — | — | — | — | 0.29 | 26.3 | 1.69 | |
| — | — | — | — | — | 0.02 | — | 0.07 | — | 0.12 | 3.83 | 1.25 | |

TABLE 2-continued

| | | | | | | | | | | | |
|---|---|---|---|---|---|---|---|---|---|---|---|
| 0.03 | — | — | — | 0.13 | — | — | — | — | 0.18 | 2.30 | 2.15 |
| — | — | 0.0003 | 0.048 | — | — | — | — | — | 0.26 | 6.01 | 1.17 |
| — | 0.06 | — | — | — | — | 0.002 | — | — | 0.39 | 6.81 | 2.49 |
| — | — | — | — | — | — | — | 0.11 | — | 0.23 | 2.55 | 1.90 |
| 0.31 | — | — | — | — | — | — | — | — | 0.06 | 1.64 | 1.45 |
| — | — | — | — | — | — | — | — | — | 0.10 | 2.18 | 2.27 |
| — | — | — | 0.036 | — | — | — | — | — | 0.64 | 10.2 | 1.82 |
| — | — | 0.0030 | — | — | — | 0.002 | — | 0.11 | 0.76 | 8.95 | 2.56 |

fn1 = Ti (%) − 1.2S (%),
fn2 = Ti (%)/S (%)
fn3 = 0.5 Si (%) + Mn (%) + 1.13 Cr (%) + 1.9 SNi (%)

TABLE 3

| | Chemical composition (percent by weight) Balance: Fe and unavoidable impurities | | | | | | | | | | | |
|---|---|---|---|---|---|---|---|---|---|---|---|---|
| Steel | C | Si | Mn | P | S | Ti | Al | N | Cu | Ni | Cr | Mo |
| 25 | 0.23 | 1.57 | 0.40 | 0.020 | 0.133 | 0.67 | 0.020 | 0.0032 | — | 0.12 | 0.05 | — |
| 26 | 0.10 | 0.15 | 0.50 | 0.019 | 0.141 | 0.78 | 0.019 | 0 0030 | — | — | 0.55 | 0.51 |
| 27 | 0.28 | 0.40 | 1.50 | 0.019 | 0.011 | 0.19 | 0.020 | 0.0025 | — | — | 0.11 | — |
| 28 | 0.21 | 0.05 | 0.70 | 0.018 | 0.044 | 0.27 | 0.019 | 0.0018 | — | — | 1.34 | — |
| 29 | 0.20 | 0.10 | 1.54 | 0.020 | 0.015 | 0.63 | 0.020 | 0.0022 | — | — | — | 0.05 |
| 30 | 0.25 | 0.20 | 0.80 | 0.018 | 0.110 | 0.73 | 0.021 | 0.0027 | 0.04 | — | 1.20 | — |
| 31 | 0.21 | 1.05 | 1.00 | 0.019 | 0.143 | 0.44 | 0.020 | 0.0015 | — | 0.05 | 0.45 | — |
| 32 | 0.23 | 0.45 | 0.80 | 0.020 | 0.025 | 0.28 | 0.020 | 0.0013 | — | — | 0.05 | 0.20 |
| 33 | 0.14 | 0.21 | 1.51 | 0.019 | 0.032 | 0.87 | 0.020 | 0.0031 | — | — | — | 0.04 |
| 34 | 0.26 | 0.33 | 1.34 | 0.019 | 0.114 | 0.39 | 0.020 | 0.0027 | — | — | 0.64 | — |
| 35 | 0.29 | 1.60 | 0.44 | 0.018 | 0.065 | 0.24 | 0.018 | 0.0018 | — | 0.10 | 0.15 | — |
| 36 | 0.51 | 0.22 | 0.95 | 0.020 | 0.073 | 0.25 | 0.021 | 0.0070 | 0.11 | — | — | — |

| | Chemical composition (percent by weight) Balance: Fe and unavoidable impurities | | | | | | | | | | | |
|---|---|---|---|---|---|---|---|---|---|---|---|---|
| Steel | V | Nb | B | Nd | Se | Te | Ca | Pb | Bi | fn1 | fn2 | fn3 |
| 25 | — | — | — | — | — | 0.03 | — | — | — | 0.51 | 5.02 | 1.48 |
| 26 | 0.24 | — | — | — | — | — | 0.003 | — | — | 0.61 | 5.53 | 1.20 |
| 27 | — | 0.06 | 0.0011 | — | — | — | — | 0.12 | — | 0.17 | 17.0 | 1.82 |
| 28 | — | — | — | — | 0.12 | — | — | — | — | 0.22 | 6.23 | 2.24 |
| 29 | 0.07 | — | 0.0005 | — | — | — | — | — | — | 0.62 | 41.5 | 1.59 |
| 30 | — | 0.07 | — | — | — | — | — | 0.14 | — | 0.60 | 6.64 | 2.26 |
| 31 | — | — | — | — | — | — | 0.002 | — | — | 0.27 | 3.09 | 2.13 |
| 32 | 0.12 | 0.02 | 0.0010 | — | 0.21 | 0.02 | — | — | — | 0.25 | 11.1 | 1.08 |
| 33 | 0.15 | — | 0.0009 | — | — | — | — | — | — | 0.83 | 27.1 | 1.32 |
| 34 | — | — | — | 0.038 | — | — | — | 0.06 | — | 0.25 | 3.43 | 2.23 |
| 35 | 0.06 | — | 0.0016 | — | — | — | — | — | 0.10 | 0.16 | 3.65 | 1.32 |
| 36 | — | — | — | 0.050 | — | — | — | — | 0.09 | 0.16 | 3.45 | 1.06 |

fn1 = Ti (%) − 1.2S (%),
fn2 = Ti (%)/S (%)
fn3 = 0.5 Si (%) + Mn (%) + 1.13 Cr (%) + 1.9 SNi (%)

TABLE 4

| | Chemical composition (percent by weight) Balance: Fe and unavoidable impurities | | | | | | | | | | | |
|---|---|---|---|---|---|---|---|---|---|---|---|---|
| Steel | C | Si | Mn | P | S | Ti | Al | N | Cu | Ni | Cr | Mo |
| 37 | 0.04 | 0.50 | 1.40 | 0.020 | 0.058 | 0.09 | 0.020 | 0.0029 | — | — | 0.50 | — |
| 38 | 0.27 | 0.45 | 1.27 | 0.020 | 0.001 | 0.06 | 0.021 | 0.0016 | — | — | 0.14 | — |
| 39 | 0.49 | 0.31 | 0.75 | 0.020 | 0.013 | 0.03 | 0.021 | 0.0020 | — | — | — | 0.05 |
| 40 | 0.28 | 0.48 | 1.23 | 0.019 | 0.169 | 0.90 | 0.021 | 0.0180 | — | — | 0.33 | — |
| 41 | 0.23 | 0.21 | 1.61 | 0.021 | 0.012 | 0.06 | 0.020 | 0.0014 | — | — | 0.48 | — |
| 42 | 0.36 | 0.21 | 1.05 | 0.020 | 0.157 | 0.78 | 0.018 | 0.0021 | — | — | 0.22 | — |
| 43 | 0.49 | 0.41 | 0.81 | 0.020 | 0.012 | 0.16 | 0.017 | 0.0019 | — | — | — | — |
| 44 | 0.38 | 0.11 | 1.01 | 0.019 | 0.117 | 0.41 | 0.020 | 0.0036 | 0.02 | — | — | — |
| 45 | 0.26 | 0.22 | 0.78 | 0.019 | 0.169 | 0.89 | 0.020 | 0.0022 | — | — | 0.47 | 0.04 |
| 46 | 0.41 | 0.67 | 0.87 | 0.018 | 0.064 | 0.21 | 0.020 | 0.0021 | — | 0.15 | — | 0.14 |

| | Chemical composition (percent by weight) Balance: Fe and unavoidable impurities | | | | | | | | | | | |
|---|---|---|---|---|---|---|---|---|---|---|---|---|
| Steel | V | Nb | B | Nd | Se | Te | Ca | Pb | Bi | fn1 | fn2 | fn3 |
| 0.15 | — | — | — | — | — | — | — | — | 0.03 | 1.64 | 2.22 | |
| 0.03 | — | 0.0003 | — | — | 0.02 | — | — | — | 0.06 | 60.0 | 1.65 | |

TABLE 4-continued

| | | | | | | | | | | | |
|---|---|---|---|---|---|---|---|---|---|---|---|
| — | — | — | — | — | — | 0.005 | 0.16 | — | −0.02 | 2.31 | 0.91 |
| 0.12 | 0.06 | — | — | 0.18 | — | — | — | — | 0.70 | 3.45 | 1.47 |
| — | — | — | 0.120 | — | — | — | — | — | 0.27 | 3.09 | 2.13 |
| 0.07 | — | — | — | 0.53 | — | — | — | — | 0.25 | 11.1 | 1.08 |
| — | 0.04 | — | — | — | 0.06 | — | — | — | 0.83 | 27.1 | 1.32 |
| 0.10 | — | — | — | — | — | 0.013 | — | — | 0.25 | 3.43 | 2.23 |
| — | — | 0.0003 | — | — | — | — | 0.52 | — | 0.16 | 3.65 | 1.32 |
| 0.03 | — | — | — | — | — | — | — | 0.42 | 0.16 | 3.45 | 1.06 |

fn1 = Ti (%) − 1.2S (%),
fn2 = Ti (%)/S (%)
fn3 = 0.5 Si (%) + Mn (%) + 1.13 Cr (%) + 1.9 SNi (%)
The underlined values fall outside the ranges specified by the present invention.

Next, each of the steels was hot forged, such that the steel was heated to a temperature of 1250° C. and then finished at a temperature of 1000° C., to obtain a round bar having a diameter of 60 mm. The hot-forged round bars were cooled to a temperature of 300° C., at a cooling rate of 5° C./min to 35° C./min by air cooling or atmospheric cooling, thereby adjusting their microstructures, so as to obtain a tensile strength of about 845 MPa to 870 MPa. For steels 6, 7, 9, 11, 29 to 36, 40, 45 and 46, the hot-forged round bars were cooled as above and then heated at a temperature of 770° C. to 900° C. for 1 hour, followed by water quenching. The water-quenched round bars were tempered at a temperature of 550° C. to 560° C. (followed by air cooling), so as to adjust their microstructures and strengths.

Test pieces were obtained from each of the round bars at a position 15 mm deep from the surface (at a position described as a R/2 site, where R denotes the radius of the round bar). The obtained test pieces were JIS No. 14A tensile test pieces, Ono-type rotating bending fatigue test pieces (diameter of straight portions 8 mm; length of straight portion: 18.4 mm), and JIS No. 3 impact test pieces (2 mm U-notch Charpy test pieces), which were used for testing tensile strength, fatigue strength (fatigue limit), and toughness (impact value), respectively, at room temperature.

A test piece was obtained from each of the round bars at a position described as a R/2 site in accordance with FIG. 3 of JIS G 0555. In each of the obtained test pieces, the mirror-like polished surface to be observed measured 15 mm (width) by 20 mm (height). The polished surface was observed through an optical microscope at 400 magnifications over a range of 60 visual fields. Through the observation, the index of cleanliness in terms of titanium carbosulfides in the steel was measured such that titanium carbosulfides were distinguished from other inclusions, and also the maximum diameter of titanium carbosulfides was obtained. Subsequently, the mirror-like polished surface of each test piece was etched with nital. The etched surface was observed through the optical microscope at 100 magnifications so as to observe the state of microstructure, i.e. to obtain the occupancy rate (area percentage) of individual constituent phases of microstructure, at the R/2 sites.

Also, a drilling test was conducted for evaluation of machinability. Specifically, each of the round bars having a diameter of 60 mm was cut to obtain round bar blocks, each having a length of 55 mm. The blocks were drilled 50 mm d e e p in the length direction. The number of bores were counted and drilled until the drilling tool became disabled due to failure of the top cutting edge. The number of the drilled bores was defined as a machinability index indicative of machinability of steel. The drilling test was conducted through use of a 6 mm-diameter straight shank drill of high speed tool steel, JIS SKH59, and a water-soluble lubricant, at a feed of 0.20 mm/rev and a revolution of 980 rpm.

Tables 5 to 8 show the results of the above tests. Tables 5 to 8 also contain quenching and tempering conditions for steels 6, 7, 9, 11, 29 to 36, 40, 45 and 46.

TABLE 5

| | | Titanium carbosulfide | | Microstructure | | | | Mechanical properties | |
|---|---|---|---|---|---|---|---|---|---|
| | | Maximum | | | | | | Tensile | Fatigue |
| Test No. | Steel | diameter (μm) | Index of cleanliness | F (%) | P (%) | B (%) | M (%) | strength TS (MPa) | limit σw (MPa) |
| 1 | 1 | 0.4 | 0.07 | 21 | 18 | 61 | 0 | 854 | 361 |
| 2 | 2 | 0.1 | 0.06 | 60 | 26 | 14 | 0 | 857 | 362 |
| 3 | 3 | 7.6 | 0.43 | 38 | 33 | 29 | 0 | 851 | 352 |
| 4 | 4 | 1.1 | 0.06 | 22 | 23 | 54 | 0 | 853 | 316 |
| 5 | 5 | 7.2 | 0.23 | 35 | 23 | 42 | 0 | 852 | 323 |
| 6 | 6 | 8.1 | 2.10 | 0 | 0 | 68 | 32 | 850 | 360 |
| 7 | 7 | 1.5 | 0.07 | 0 | 0 | 74 | 26 | 855 | 308 |
| 8 | 8 | 6.1 | 0.35 | 50 | 24 | 26 | 0 | 852 | 366 |
| 9 | 9 | 1.9 | 0.14 | 0 | 0 | 57 | 43 | 850 | 353 |
| 10 | 10 | 5.6 | 0.33 | 25 | 28 | 47 | 0 | 857 | 363 |
| 11 | 11 | 1.7 | 0.13 | 0 | 0 | 87 | 13 | 857 | 365 |
| 12 | 12 | 5.1 | 0.31 | 58 | 30 | 12 | 0 | 854 | 363 |

TABLE 5-continued

| Test No. | Mechanical properties: Endurance ratio σw/TS | Charpy impact value (J/cm$^2$) | Machinability index | Quenching & tempering conditions: Heating temperature for quenching (°C.) | Heating temperature for tempering (°C.) |
|---|---|---|---|---|---|
| 1 | 0.42 | 65 | 202 | — | — |
| 2 | 0.42 | 66 | 222 | — | — |
| 3 | 0.41 | 64 | 227 | — | — |
| 4 | 0.37 | 66 | 214 | — | — |
| 5 | 0.38 | 65 | 205 | — | — |
| 6 | 0.42 | 76 | 201 | 890 | 550 |
| 7 | 0.36 | 73 | 219 | 850 | 550 |
| 8 | 0.43 | 67 | 316 | — | — |
| 9 | 0.41 | 75 | 327 | 770 | 560 |
| 10 | 0.42 | 69 | 300 | — | — |
| 11 | 0.43 | 74 | 317 | 890 | 550 |
| 12 | 0.43 | 64 | 318 | — | — |

In the "Microstructure" column,
F denotes ferrite,
P denotes pearlite,
B denotes bainite, and
M denotes martensite.

TABLE 6

| Test No. | Steel | Titanium carbosulfide: Maximum diameter (μm) | Index of cleanliness | Microstructure: F (%) | P (%) | B (%) | M (%) | Mechanical properties: Tensile strength TS (MPa) | Fatigue limit σw (MPa) |
|---|---|---|---|---|---|---|---|---|---|
| 13 | 13 | 0.8 | 0.09 | 35 | 14 | 51 | 0 | 855 | 347 |
| 14 | 14 | 5.8 | 0.34 | 60 | 23 | 16 | 0 | 851 | 362 |
| 15 | 15 | 2.5 | 0.18 | 64 | 36 | 0 | 0 | 853 | 356 |
| 16 | 16 | 5.9 | 0.35 | 24 | 76 | 0 | 0 | 857 | 366 |
| 17 | 17 | 3.2 | 0.21 | 47 | 53 | 0 | 0 | 856 | 361 |
| 18 | 18 | 2.7 | 0.19 | 23 | 75 | 2 | 0 | 851 | 357 |
| 19 | 19 | 4.3 | 0.26 | 60 | 34 | 5 | 0 | 856 | 361 |
| 20 | 20 | 3.8 | 0.24 | 32 | 65 | 3 | 0 | 852 | 342 |
| 21 | 21 | 1.3 | 0.12 | 63 | 30 | 7 | 0 | 859 | 350 |
| 22 | 22 | 0.7 | 0.09 | 0 | 0 | 100 | 0 | 393 | 855 |
| 23 | 23 | 6.8 | 0.39 | 0 | 0 | 100 | 0 | 413 | 862 |
| 24 | 24 | 8.3 | 0.46 | 0 | 0 | 100 | 0 | 402 | 857 |

| Test No. | Mechanical properties: Endurance ratio σw/TS | Charpy impact value (J/cm$^2$) | Machinability index | Quenching & tempering conditions: Heating temperature for quenching (°C.) | Heating temperature for tempering (°C.) |
|---|---|---|---|---|---|
| 13 | 0.41 | 66 | 300 | — | — |
| 14 | 0.43 | 65 | 317 | — | — |
| 15 | 0.42 | 65 | 308 | — | — |
| 16 | 0.43 | 65 | 312 | — | — |
| 17 | 0.42 | 64 | 310 | — | — |
| 18 | 0.42 | 69 | 304 | — | — |
| 19 | 0.42 | 69 | 330 | — | — |
| 20 | 0.40 | 65 | 302 | — | — |
| 21 | 0.41 | 63 | 319 | — | — |
| 22 | 0.46 | 87 | 310 | — | — |

TABLE 6-continued

| | | | | | |
|---|---|---|---|---|---|
| 23 | 0.48 | 85 | 311 | — | — |
| 24 | 0.47 | 90 | 301 | — | — |

In the "Microstructure" column,
F denotes ferrite,
P denotes pearlite,
B denotes bainite, and
M denotes martensite.

TABLE 7

| | | Titanium carbosulfide | | Microstructure | | | | Mechanical properties | |
|---|---|---|---|---|---|---|---|---|---|
| Test No. | Steel | Maximum diameter (μm) | Index of cleanliness | F (%) | P (%) | B (%) | M (%) | Tensile strength TS (MPa) | Fatigue limit σw (MPa) |
| 25 | 25 | 6.2 | 0.36 | 0 | 0 | 100 | 0 | 854 | |
| 26 | 26 | 7.3 | 0.42 | 0 | 0 | 93 | 7 | 865 | |
| 27 | 27 | 1.4 | 0.12 | 0 | 0 | 95 | 5 | 863 | |
| 28 | 28 | 2.2 | 0.16 | 6 | 0 | 94 | 0 | 860 | |
| 29 | 29 | 5.8 | 0.34 | 0 | 0 | 24 | 76 | 868 | |
| 30 | 30 | 6.8 | 0.39 | 0 | 0 | 24 | 76 | 866 | |
| 31 | 31 | 3.9 | 0.25 | 0 | 0 | 40 | 60 | 861 | |
| 32 | 32 | 2.3 | 0.16 | 0 | 0 | 21 | 79 | 867 | |
| 33 | 33 | 8.2 | 0.46 | 0 | 0 | 34 | 66 | 869 | |
| 34 | 34 | 3.4 | 0.22 | 0 | 0 | 0 | 100 | 869 | |
| 35 | 35 | 1.9 | 0.14 | 0 | 0 | 28 | 72 | 868 | |

| | Mechanical properties | | | Quenching & tempering conditions | |
|---|---|---|---|---|---|
| Test No. | Endurance ratio σw/TS | Charpy impact value (J/cm$^2$) | Machinability index | Heating temperature for quenching (°C.) | Heating temperature for tempering (°C.) |
| 397 | 0.46 | 89 | 319 | — | — |
| 405 | 0.47 | 83 | 302 | — | — |
| 394 | 0.46 | 83 | 303 | — | — |
| 390 | 0.45 | 82 | 311 | — | — |
| 440 | 0.51 | 104 | 321 | 890 | 550 |
| 456 | 0.53 | 103 | 326 | 900 | 550 |
| 434 | 0.50 | 103 | 313 | 880 | 550 |
| 439 | 0.51 | 104 | 307 | 830 | 550 |
| 438 | 0.50 | 101 | 313 | 850 | 550 |
| 449 | 0.52 | 102 | 301 | 900 | 550 |
| 451 | 0.52 | 100 | 307 | 890 | 550 |

In the "Microstructure" column,
F denotes ferrite,
P denotes pearlite,
B denotes bainite, and
M denotes martensite.

TABLE 8

| | | Titanium carbosulfide | | Microstructure | | | | Mechanical properties | |
|---|---|---|---|---|---|---|---|---|---|
| Test No. | Steel | Maximum diameter (μm) | Index of cleanliness | F (%) | P (%) | B (%) | M (%) | Tensile strength TS (MPa) | Fatigue limit σw (MPa) |
| 36 | 36 | 2.3 | * 0.04 | 0 | 0 | 62 | 38 | 854 | 340 |
| 37 | * 37 | 0.5 | 0.08 | 97 | 3 | 0 | 0 | 845 | 314 |
| 38 | * 38 | 0.1 | * 0.02 | 53 | 34 | 13 | 0 | 847 | 324 |
| 39 | * 39 | 1.3 | 0.13 | 19 | 30 | 52 | 0 | 851 | 336 |
| 40 | * 40 | 9.7 | 0.55 | 0 | 0 | 56 | 44 | 847 | 320 |

TABLE 8-continued

| | | | | | | | | | |
|---|---|---|---|---|---|---|---|---|---|
| 41 | * 41 | 0.1 | 0.06 | 57 | 27 | 16 | 0 | 857 | 317 |
| 42 | * 42 | 7.5 | 0.42 | 38 | 33 | 29 | 0 | 840 | 303 |
| 43 | * 43 | 1.1 | 0.10 | 23 | 24 | 53 | 0 | 859 | 309 |
| 44 | * 44 | 3.6 | 0.21 | 35 | 24 | 41 | 0 | 858 | 318 |
| 45 | * 45 | 8.0 | 2.05 | 0 | 0 | 56 | 44 | 846 | 296 |
| 46 | * 46 | 1.4 | 0.12 | 0 | 0 | 78 | 22 | 846 | 304 |

| | Mechanical properties | | | Quenching & tempering conditions | |
|---|---|---|---|---|---|
| Test No. | Endurance ratio σw/TS | Charpy impact value (J/cm²) | Machinability index | Heating temperature for quenching (°C.) | Heating temperature for tempering (°C.) |
| 36 | 0.40 | 106 | 51 | 900 | 550 |
| 37 | 0.37 | 67 | 58 | — | — |
| 38 | 0.38 | 88 | 31 | — | — |
| 39 | 0.39 | 85 | 40 | — | — |
| 40 | 0.38 | 103 | 45 | 890 | 550 |
| 41 | 0.37 | 34 | 216 | — | — |
| 42 | 0.36 | 35 | 237 | — | — |
| 43 | 0.36 | 56 | 208 | — | — |
| 44 | 0.37 | 55 | 200 | — | — |
| 45 | 0.35 | 69 | 201 | 890 | 550 |
| 46 | 0.86 | 66 | 211 | 850 | 550 |

In the "Microstructure" column,
F denotes ferrite,
P denotes pearlite,
B denotes bainite, and
M denotes martensite.
The values marked with *, fall outside the conditions specified by the present invention.

As seen from Tables 5 to 8, in test Nos. 1 to 35, the machinability indices are in excess of 200. The tested steels 1 to 35 contain C, S, Ti and N in amounts falling within respective ranges, as specified in the present invention and have a maximum diameter of titanium carbosulfides, not greater than 10 μm and a index of cleanliness in terms of titanium carbosulfide not lower than 0.05%. By contrast, in test No. 36, the machinability index is as low as 51, since the tested steel 36 has a index of cleanliness in terms of titanium carbosulfide lower than 0.05% despite its C, S, Ti and N contents, falling within respective ranges as specified in the present invention. In test Nos. 37, 39 and 40, the machinability indices are as low as 58, 40 and 45, respectively, since some of the C, Ti and N contents of the tested steels 37, 39 and 40 fall outside the corresponding range as specified in the present invention. In test No. 38, the machinability index is as low as 31, since the S content of the tested steel 38 falls outside the corresponding range, as specified in the present invention, and also the tested steel 38 has a index of cleanliness in terms of titanium carbosulfide lower than 0.05%.

As described above, when machinability is evaluated while the tensile strength is maintained at substantially the same level, the steels, according to the present invention, show excellent machinability.

In test Nos. 41 to 46, in which the Nd, Se, Te, Ca, Pb and Bi contents of the tested steels 41 to 46, respectively, fall outside respective ranges as specified in the present invention, machinability is favorable, but fatigue strength and/or toughness is inferior to that of test Nos. 2 to 7, in which the tested steels 2 to 7 contain these elements in amounts falling within respective ranges, as specified in the present invention.

As seen from Tables 5 to 8, in the steels according to the present invention, excellent balance between machinability and fatigue strength is attained when the maximum diameter of a titanium carbosulfide is 0.5 μm to 7 μm, and the index of cleanliness in terms of titanium carbosulfide is 0.08% to 2.0%. Further, when bainite or a combination of ferrite and bainite accounts for at least 90% of microstructure, good balance between strength and toughness is established. When martensite accounts for at least 50% of microstructure, balance between strength and toughness becomes extremely excellent.

Example 2

Steels 47 to 54 having chemical compositions shown in Table 9 were manufactured through a melting process in a 150 kg vacuum melting furnace or a 3-ton vacuum melting furnaces Steels 47 to 49 were manufactured through a melting process in the 3-ton vacuum melting furnace, and other steels were manufactured through a melting process in the 150 kg vacuum melting furnace. In order to prevent the generation of titanium oxides, the steels underwent adjustment of the size and the index of cleanliness of titanium carbosulfide. This adjustment was carried out by adding Ti, after various elements had been added, subsequent to sufficient deoxidization with Si and Al. Steels 47 to 54 in Table 9 are examples of the present invention, and contain each component element in an amount falling in a range specified by the present invention.

TABLE 9

| | Chemical composition (percent by weight) Balance: Fe and unavoidable impurities | | | | | | | | | | | |
|---|---|---|---|---|---|---|---|---|---|---|---|---|
| Steel | C | Si | Mn | P | S | Ti | Al | N | Cu | Ni | Cr | Mo |
| 47 | 0.47 | 0.46 | 1.50 | 0.036 | 0.143 | 0.11 | 0.029 | 0.0039 | — | — | 0.50 | — |
| 48 | 0.26 | 0.80 | 1.05 | 0.033 | 0.102 | 0.69 | 0.021 | 0.0034 | 0.10 | — | 0.21 | 0.54 |
| 49 | 0.46 | 0.83 | 0.99 | 0.035 | 0.010 | 0.70 | 0.019 | 0.0036 | — | — | 0.50 | — |
| 50 | 0 34 | 0.39 | 0.63 | 0.031 | 0.132 | 0.60 | 0.030 | 0.0039 | 0.16 | — | — | — |
| 51 | 0.34 | 0.33 | 1.07 | 0.021 | 0.093 | 0.58 | 0.020 | 0 0014 | — | — | — | — |
| 52 | 0.27 | 0.80 | 1.05 | 0.037 | 0.164 | 0.68 | 0.020 | 0.0039 | — | — | 0.41 | — |
| 53 | 0.28 | 0.26 | 1.00 | 0.019 | 0.140 | 0.70 | 0.019 | 0.0035 | — | — | 0.50 | — |
| 54 | 0.48 | 0.50 | 1.48 | 0.029 | 0.141 | 0.20 | 0.019 | 0.0021 | — | — | 0.48 | — |

| | Chemical composition (percent by weight) Balance: Fe and unavoidable impurities | | | | | | | | | | | |
|---|---|---|---|---|---|---|---|---|---|---|---|---|
| Steel | V | Nb | B | Nd | Se | Te | Ca | Pb | Bi | fn1 | fn2 | fn3 |
| — | — | — | — | — | — | 0.003 | 0.08 | — | −0.06 | 0.77 | 2.30 | |
| 0.12 | — | — | — | 0.15 | — | — | 0.08 | — | 0.57 | 6.76 | 1 69 | |
| — | 0.04 | — | — | 0.13 | 0.01 | — | — | 0.04 | 0.69 | 70.0 | 1.97 | |
| 0.22 | — | — | 0.048 | — | — | — | — | — | 0.44 | 4.55 | 0 83 | |
| 0.17 | 0.04 | — | — | — | — | 0.002 | — | — | 0.47 | 6.24 | 1.24 | |
| 0.12 | — | — | 0.037 | — | — | — | 0.13 | — | 0.48 | 4.15 | 1.91 | |
| — | 0.04 | — | — | — | — | 0.001 | — | 0.09 | 0.53 | 5.00 | 1.70 | |
| — | — | — | — | — | — | 0.002 | 0.07 | — | 0.03 | 1.42 | 2.27 | |

fn1 = Ti (%) − 1.2S (%),
fn2 = Ti (%)/S (%)
fn3 = 0.5 Si (%) + Mn (%) + 1.13 Cr (%) + 1.9 SNi (%)

Next, each of the steels was hot forged such that the steel was heated to a temperature of 1250° C. and then finished at a temperature of 1000° C., to obtain a round bar having a diameter of 60 mm. The hot-forged round bars were cooled to a temperature of 400° C., at a cooling rate of 5° C./min to 35° C./min by air cooling or atmospheric cooling, thereby adjusting tensile strength through attainment of a microstructure which is primarily composed of ferrite and pearlite.

Test pieces for use in various tests were obtained from each of the round bars at a position as deep as R/2 from the surface of the round bar in a manner similar to that of Example 1. The obtained test pieces were JIS No. 14A tensile test pieces, Ono-type rotating bending fatigue test pieces (diameter of straight portion: 8 mm; length of straight portion: 18.4 mm), and JIS No. 3 impact test pieces (2 mm U-notch Charpy test pieces), which were used for testing tensile strength, fatigue strength (fatigue limit), and toughness (impact value), respectively, at room temperature.

A test piece was obtained from each of the round bars at a position described as a R/2 site in accordance with FIG. 3 of JIS G 0555. In each of the obtained test pieces, the mirror-like polished surface to be observed measured 15 mm (width) by 20 mm (height). The polished surface was observed through an optical microscope at 400 magnifications over a range of 60 visual fields. Through the observation, the index of cleanliness in terms of titanium carbosulfides in the steel was measured such that titanium carbosulfides were distinguished from other inclusions, and also the maximum diameter of titanium carbosulfides was obtained. Subsequently, the mirror-like polished surface of each test piece was etched with nital. The etched surface was observed through the optical microscope at 100 magnifications so as to observe the state of microstructure, i.e. to obtain the occupancy rate (area percentage) of individual constituent phases of microstructure, at the R/2 site. In test Nos. 51 to 53 corresponding to the tested steels 51 to 53, the ferrite grain size number as specified in JIS was measured, and the average lamellar spacing of pearlite was obtained from photographs taken through a scanning electron microscope.

Also, a drilling test was conducted for evaluation of machinability. The test conditions and the evaluation method were similar to those of Example 1.

Table 10 shows the results of the above tests.

TABLE 10

| | | Titanium carbosulfide | | Microstructure | | | | | |
|---|---|---|---|---|---|---|---|---|---|
| | | | | F | | P | | | |
| | | Maximum | | | | | average | | |
| Test No. | Steel | diameter μm) | Index of cleanliness | (%) | JIS GS No. | (%) | lamelar spacing (μm) | B (%) | M (%) |
| 47 | 47 | 6.4 | 0.21 | 22 | — | 78 | — | 0 | 0 |
| 48 | 48 | 7.1 | 1.19 | 55 | — | 45 | — | 0 | 0 |
| 49 | 49 | 7.2 | 1.21 | 24 | — | 76 | — | 0 | 0 |
| 50 | 50 | 6.5 | 1.03 | 43 | — | 55 | — | 2 | 0 |
| 51 | 51 | 4.3 | 0.26 | 43 | 9 | 52 | 0.15 | 5 | 0 |

TABLE 10-continued

| | | | | | | | | | |
|---|---|---|---|---|---|---|---|---|---|
| 52 | 52 | 3.8 | 0.24 | 54 | 9 | 44 | 0.16 | 3 | 0 |
| 53 | 53 | 1.3 | 0.12 | 52 | 6 | 41 | 0.13 | 7 | 0 |
| 54 | 54 | 5.8 | 0.25 | 20 | — | 80 | — | 0 | 0 |

| Mechanical properties | | | | | | Quenching & tempering conditions | |
|---|---|---|---|---|---|---|---|
| Test No. | Tensile strength TS (MPa) | Fatigue limit σw (MPa) | Endurance ratio σw/TS | Charpy impact value (J/cm$^2$) | Machinability index | Heating temperature for quenching (°C.) | Heating temperature for tempering (°C.) |
| 47 | 835 | 376 | 0.45 | 66 | 302 | — | — |
| 48 | 878 | 400 | 0.46 | 64 | 320 | — | — |
| 49 | 865 | 433 | 0.50 | 64 | 319 | — | — |
| 50 | 827 | 379 | 0.46 | 68 | 333 | — | — |
| 51 | 843 | 405 | 0.48 | 71 | 336 | — | — |
| 52 | 884 | 424 | 0.48 | 70 | 338 | — | — |
| 53 | 859 | 399 | 0.46 | 73 | 334 | — | — |
| 54 | 833 | 383 | 0.46 | 68 | 308 | — | — |

In the "Microstructure" colum,
F denotes ferrite.
P denotes pearlite.
B denotes bainite. and
M denotes martensite.
In the "JIS grain size No. (GS No.) of F" colum and "average lamellar spacing of P" column, "—"indicate that no measurement was carried out.

As seen from Table 10, in the case of non-heat-treated type steel products in which ferrite and pearlite account for at least 90% of microstructure, good balance between strength and toughness is obtained when at least one of the following conditions is satisfied: the area percentage of ferrite is 20% to 70%; the grain size of ferrite in terms of JIS grain size number is not smaller than 5; and the average lamellar spacing of pearlite is 0.2 μm or less. Moreover, the machinability index assumes a relatively large value when the value of fn1 represented by the aforementioned equation (1) is greater than 0%, and/or the value of fn2 represented by the aforementioned equation (2) is greater than 2. When the value of fn2, expressed by the equation (2), is greater than 2, fatigue strength is also relatively high.

Example 3

Steels 55 to 59 having chemical compositions shown in Table 11 were manufactured through a melting process in a 150 kg vacuum melting furnace or a 3-ton vacuum melting furnace. Steels 55 and 56 were manufactured through a melting process in the 3-ton vacuum melting furnace, and other steels were manufactured through a melting process in the 150 kg vacuum melting furnace. In order to prevent the generation of titanium oxides, the steels underwent adjustment of the size and the index of cleanliness of titanium carbosulfide, in this example too. This adjustment was carried out by adding Ti, after various elements had been added, subsequent to sufficient deoxidization with Si and Al. Steels 55 to 59 in Table 11 are examples of the present invention, and contain each component element in an amount falling in a range specified by the present invention.

TABLE 11

| Chemical composition (percent by weight) Balance: Fe and unavoidable impurities | | | | | | | | | | | | |
|---|---|---|---|---|---|---|---|---|---|---|---|---|
| Steel | C | Si | Mn | P | S | Ti | Al | N | Cu | Ni | Cr | Mo |
| 55 | 0.07 | 1.28 | 2.41 | 0.032 | 0.080 | 0.89 | 0.020 | 0.0026 | — | — | — | — |
| 56 | 0.12 | 0.81 | 1.75 | 0.020 | 0.157 | 0.32 | 0.021 | 0.0039 | — | — | 0.51 | — |
| 57 | 0.10 | 1.16 | 1.34 | 0.020 | 0.161 | 0.15 | 0.019 | 0.0023 | — | 1.06 | 0.28 | — |
| 58 | 0.22 | 0.34 | 2.45 | 0.019 | 0.007 | 0.29 | 0.020 | 0.0032 | — | — | 0.40 | 0.24 |
| 59 | 0.11 | 1.18 | 1.30 | 0.015 | 0.158 | 0.21 | 0.015 | 0.0020 | — | 1.03 | 0.25 | — |

| Chemical composition (percent by weight) Balance: Fe and unavoidable impurities | | | | | | | | | | | | |
|---|---|---|---|---|---|---|---|---|---|---|---|---|
| Steel | V | Nb | B | Nd | Se | Te | Ca | Pb | Bi | fn1 | fn2 | fn3 |
| 55 | — | — | — | — | — | — | — | — | — | 0.79 | 11.1 | 3.05 |
| 56 | — | — | — | 0.036 | — | — | — | — | — | 0.13 | 2.04 | 2.73 |
| 57 | — | — | 0.0014 | — | — | — | 0.002 | — | 0.11 | −0.04 | 0.93 | 4.34 |

TABLE 11-continued

| | | | | | | | | | | | | |
|---|---|---|---|---|---|---|---|---|---|---|---|---|
| 58 | 0.05 | 0.06 | — | 0.030 | — | 0.03 | — | 0.07 | — | 0.28 | 41.4 | 3.07 |
| 59 | — | — | 0.0011 | — | — | — | 0.002 | — | 0.08 | 0.02 | 1.33 | 4.21 |

fn1 = Ti (%) − 1.2 S (%)
fn2 = Ti (%)/S (%)
fn3 = 0.5 Si (%) + Mn (%) + 1.13 Cr (%) + 1.98 Ni (%)

Next, each of the steels was hot forged, such that the steel was heated to a temperature of 1250° C. and then finished at a temperature of 1000° C., to obtain a round bar having a diameter of 60 mm. The hot-forged round bars were cooled to a temperature of 300° C., at a cooling rate of 5° C./min to 35° C./min by air cooling or atmospheric cooling, thereby adjusting tensile-strength through attainment of a microstructure which is primarily composed of bainite, or ferrite and bainite. In the case of steels 57 and 58, aged steel was also tested (test Nos. 60 and 61). Specifically, the hot-forged round bars of steels 57 and 58 were cooled as above and then aged, i.e. heated at a temperature of 560° C. for 1 hour, followed by air cooling.

Test pieces for use in various tests were obtained from each of the round bars at a position as deep as R/2 from the surface of the round bar in a manner similar to that of Example 1. The obtained test pieces were JIS No. 14A tensile test pieces, Ono-type rotating bending fatigue test pieces (diameter of straight portion: 8 mm; length of straight portion: 18.4 mm), and JIS No. 3 impact test pieces (2 mm U-notch Charpy test pieces), which were used for testing tensile strength, fatigue strength (fatigue limit), and toughness (impact value), respectively, at room temperature.

A test piece was obtained from each of the round bars at a position described as a R/2 site in accordance with FIG. 3 of JIS G 0555. In each of the obtained test pieces, the mirror-like polished surface to be observed measured 15 mm (width) by 20 mm (height). The polished surface was observed through an optical microscope at 400 magnifications over a range of 60 visual fields. Through the observation, the index of cleanliness in terms of titanium carbosulfides in the steel was measured such that titanium carbosulfides were distinguished from other inclusions, and also the maximum diameter of titanium carbosulfides was obtained. Subsequently, the mirror-like polished surface of each test piece was etched with nital. The etched surface was observed through the optical microscope at 100 magnifications so as to observe the state of microstructure, i.e. to obtain the occupancy rate (area percentage) of individual constituent phases of microstructure, at the R/2 site.

Also, a drilling test was conducted for evaluation of machinability. The test conditions and the evaluation method were similar to those of Example 1.

Table 12 shows the results of the above tests. Table 12 also contains the conditions of aging treatment conducted on steels 57 and 58 in test Nos. 60 and 61.

TABLE 12

| | | Titanium carbosulfide | | Microstructure | | | | Mechanical properties | | | | | Quenching & tempering conditions | |
|---|---|---|---|---|---|---|---|---|---|---|---|---|---|---|
| Test No. | Steel | Maximum diameter (μm) | Index of cleanliness | F (%) | P (%) | B (%) | M (%) | Tensile strength TS (MPa) | Fatigue limit σw (MPa) | Endurance ratio σw/TS | Charpy impact value (J/cm²) | Machinability index | Heating temperature for quenching (°C.) | Heating temperature for tempering (°C.) |
| 55 | 55 | 7.2 | 0.61 | 48 | 0 | 52 | 0 | 862 | 414 | 0.48 | 88 | 320 | — | — |
| 56 | 56 | 5.8 | 0.23 | 23 | 0 | 77 | 0 | 844 | 397 | 0.47 | 89 | 321 | — | — |
| 57 | 57 | 5.1 | 0.11 | 0 | 0 | 100 | 0 | 884 | 410 | 0.46 | 82 | 301 | — | — |
| 58 | 58 | 3.4 | 0.20 | 0 | 0 | 100 | 0 | 867 | 442 | 0.51 | 89 | 329 | — | — |
| 59 | 59 | 5.3 | 0.13 | 2 | 0 | 98 | 0 | 880 | 414 | 0.47 | 81 | 305 | — | — |
| 60 | 57 | 5.1 | 0.11 | 0 | 0 | 100 | 0 | 882 | 415 | 0.47 | 88 | 305 | — | 560 |
| 61 | 58 | 3.4 | 0.20 | 0 | 0 | 100 | 0 | 863 | 449 | 0.52 | 94 | 333 | — | 560 |

In the "Microstructure" colum,
F denotes ferrite,
P denotes pearlite,
B denotes bainite, and
M denotes martensite.
In test Nos. 60 and 61, the temperature appearing in the "heating temperature for tempering" column is the "temperature for aging treatment".

As seen from Table 12, in the case of non-heat-treated type steel products in which bainite, or ferrite and bainite account for at least 90% of microstructure, good balance between strength and toughness is obtained by conducting aging treatment after hot working and subsequent cooling. Moreover, the machinability index assumes a relatively large value when the value of fn1 expressed by the aforementioned equation (1) is greater than 0%, and/or the value of fn2 expressed by the aforementioned equation (2) is greater than 2. When the value of fn2, represented by the equation (2), is greater than 2, fatigue strength is also relatively high.

Example 4

Steels 60 to 64 having chemical compositions shown in Table 13 were manufactured through a melting process in a 150 kg vacuum melting furnace or a 3-ton vacuum melting furnace. Steels 60 and 61 were manufactured through a melting process in the 3-ton vacuum melting furnace, and other steels were manufactured through a melting process in the 150 kg vacuum melting furnace. In order to prevent the generation of titanium oxides, the steels underwent adjustment of the size and the index of cleanliness of titanium carbosulfide, in this example too. This adjustment was carried out by adding Ti, after various elements had been added, subsequent to sufficient deoxidization with Si and Al. Steels 60 to 64 in Table 13 are examples of the present invention, and contain each component element in an amount falling in a range specified by the present invention.

TABLE 13

| Chemical composition (percent by weight) Balance: Fe and unavoidable impurities | | | | | | | | | | | | |
|---|---|---|---|---|---|---|---|---|---|---|---|---|
| Steel | C | Si | Mn | P | S | Ti | Al | N | Cu | Ni | Cr | Mo |
| 60 | 0.36 | 1.28 | 1.06 | 0.020 | 0.087 | 0.05 | 0.020 | 0.0020 | — | — | 0.20 | — |
| 61 | 0.31 | 1.22 | 1.14 | 0.020 | 0.165 | 0.61 | 0.021 | 0.0027 | — | — | 1.04 | — |
| 62 | 0.20 | 0.93 | 1.13 | 0.021 | 0.192 | 0.54 | 0.021 | 0.0015 | 0.70 | — | 0.80 | — |
| 63 | 0.20 | 1.17 | 1.34 | 0.018 | 0.025 | 0.35 | 0.021 | 0.0013 | — | — | 0.80 | 0.04 |
| 64 | 0.33 | 1.32 | 1.11 | 0.015 | 0.091 | 0.12 | 0.025 | 0.0015 | — | — | 0.18 | — |

| Chemical composition (percent by weight) Balance: Fe and unavoidable impurities | | | | | | | | | | | | |
|---|---|---|---|---|---|---|---|---|---|---|---|---|
| Steel | V | Nb | B | Nd | Se | Te | Ca | Pb | Bi | fn1 | fn2 | fn3 |
| 60 | — | — | 0.0003 | — | — | — | — | 0.08 | — | −0.05 | 0.57 | 1.93 |
| 61 | — | — | — | 0.038 | — | — | — | 0.14 | — | 0.41 | 3.70 | 2.93 |
| 62 | — | — | — | — | — | — | 0.002 | — | 0.05 | 0.31 | 2.81 | 2.50 |
| 63 | 0.17 | — | — | — | 0.21 | 0.02 | — | — | — | 0.32 | 14.1 | 2.83 |
| 64 | — | — | 0.0003 | — | — | — | — | 0.09 | — | 0.01 | 1.32 | 1.97 |

fn1 = Ti (%) − 1.2 S (%)
fn2 = Ti (%)/S (%)
fn3 = 0.5 Si (%) + Mn (%) + 1.13 Cr (%) + 1.98 Ni (%)

Next, each of the steels was hot forged, such that the steel was heated to a temperature of 1250° C. and then finished at a temperature of 1000° C., to obtain a round bar having a diameter of 60 mm. The hot-forged round bars were cooled to a temperature of 300° C., at a cooling rate of 5° C./min to 35° C./min by air cooling or atmospheric cooling. Subsequently, the hot-forged round bars were heated at a temperature of 850° C. to 900° C. for 1 hour, followed by water quenching. The water-quenched round bars were tempered at a temperature of 550° C. (followed by air cooling) so as to adjust their microstructures and strengths.

Test pieces for use in various tests were obtained from each of the round bars at a position as deep as R/2 from the surface of the round bar in a manner similar to that of Example 1. The obtained test pieces were JIS No. 14A tensile test pieces, Ono-type rotating bending fatigue test pieces (diameter of straight portion: 8 mm; length of straight portion: 18.4 mm), and JIS No. 3 impact test pieces (2 mm U-notch Charpy test pieces), which were used for testing tensile strength, fatigue strength (fatigue limit), and toughness (impact value), respectively, at room temperature.

A test piece was obtained from each of the round bars at a position described as a R/2 site in accordance with FIG. 3 of JIS G 0555. In each of the obtained test pieces, the mirror-like polished surface to be observed measured 15 mm (width) by 20 mm (height). The polished surface was observed through an optical microscope at 400 magnifications over a range of 60 visual fields. Through the observation, the index of cleanliness in terms of titanium carbosulfides in the steel was measured such that titanium carbosulfides were distinguished from other inclusions, and also the maximum diameter of titanium carbosulfides was obtained. Subsequently, the mirror-like polished surface of each test piece was etched with nital. The etched surface was observed through the optical microscope at 100 magnifications so as to observe the state of microstructure, i.e. to obtain the occupancy rate (area percentage) of individual constituent phases of microstructure, at the R/2 site.

Also, a drilling test was conducted for evaluation of machinability. The test conditions and the evaluation method were similar to those of Example 1.

Table 14 shows the results of the above tests. Table 14 also contains quenching and tempering conditions for steels 60 to 64.

TABLE 14

| | | Titanium carbosulfide | | Microstructure | | | | Mechanical properties | | | | | Quenching & tempering conditions | |
|---|---|---|---|---|---|---|---|---|---|---|---|---|---|---|
| Test No. | Steel | Maximum diameter (μm) | Index of cleanliness | F (%) | P (%) | B (%) | M (%) | Tensile strength TS (MPa) | Fatigue limit σw (MPa) | Endurance ratio σw/TS | Charpy impact value (J/cm²) | Machinability index | Heating temperature for quenching (°C.) | Heating temperature for tempering (°C.) |
| 62 | 60 | 3.5 | 0.05 | 0 | 0 | 0 | 100 | 835 | 438 | 0.52 | 105 | 321 | 890 | 550 |
| 63 | 61 | 7.2 | 0.41 | 0 | 0 | 0 | 100 | 858 | 450 | 0.53 | 106 | 326 | 900 | 550 |
| 64 | 62 | 7.3 | 0.37 | 0 | 0 | 9 | 91 | 847 | 449 | 0.53 | 104 | 313 | 850 | 550 |

TABLE 14-continued

| Test No. | Steel | Titanium carbosulfide: Maximum diameter (μm) | Titanium carbosulfide: Index of cleanliness | Microstructure: F (%) | Microstructure: P (%) | Microstructure: B (%) | Microstructure: M (%) | Mechanical properties: Tensile strength TS (MPa) | Mechanical properties: Fatigue limit σw (MPa) | Mechanical properties: Endurance ratio σw/TS | Mechanical properties: Charpy impact value (J/cm²) | Mechanical properties: Machinability index | Quenching & tempering conditions: Heating temperature for quenching (°C.) | Quenching & tempering conditions: Heating temperature for tempering (°C.) |
|---|---|---|---|---|---|---|---|---|---|---|---|---|---|---|
| 65 | 63 | 3.9 | 2.40 | 0 | 0 | 14 | 86 | 871 | 488 | 0.56 | 100 | 307 | 870 | 550 |
| 66 | 64 | 3.3 | 0.06 | 0 | 0 | 0 | 100 | 831 | 424 | 0.51 | 100 | 307 | 890 | 550 |

In the "Microstructure" colum,
F denotes ferrite,
P denotes pearlite,
B denotes bainite, and
M denotes martensite.

As seen from Table 14, in the case of heat-treated type steel products in which martensite accounts for at least 50% of microstructure, extremely excellent balance between strength and toughness is obtained. Moreover, the machinability index assumes a relatively large value when the value of fn1 represented by the aforementioned equation (1) is greater than 0%, and/or the value of fn2 represented by the aforementioned equation (2) is greater than 2. When the value of fn2, expressed by the equation (2), is greater than 2, fatigue strength is also relatively high.

Example 5

A portion of each of steels 1, 6, 36 to 40, 47 to 49, 55, 56, 60 and 61, which were manufactured through a melting process in a 3-ton vacuum melting furnace, as described in examples 1 to 4, was hot forged, such that the steel was heated to a temperature of 1250° C. and then finished at a temperature of 1000° C., followed by atmospheric cooling to room temperature, thereby obtaining a square bar 125 mm square.

Next, each of the square bars was hot die forged, such that the square bar was heated to a temperature of 1250° C. and then finished at a temperature not less than 1000° C. The hot-die-forged square bars were cooled to a temperature of 300° C., at a cooling rate of 5° C./min to 35° C./min by air cooling or atmospheric cooling, in order to obtain near net shape products of crankshaft. The thus-obtained near net shape products were machined to obtain finished crankshafts. For test Nos. 68, 69, 73, 79 and 80, the hot-die-forged square bars were cooled as above and then heated at a temperature of 890° C. to 900° C. for 1 hours followed by water quenching. The water-quenched square bars were tempered at a temperature of 550° C. (followed by air cooling) to obtain near net shape products of crankshafts. The thus-obtained near net shape products were machined to obtain finished crankshafts.

In machining the near net shape products in order to obtain finished crankshafts, there was used the coated carbide insert having the shape as defined by the designation code CNMG12041N-UX in JIS. The machining was of dry type and carried out at a cutting speed of 100 m/min, a depth of cut of 1.5 mm, and a feed of 0.25 mm/rev. Subsequently, an oil hole was drilled in each of the crankshafts through use of a 6 mm-diameter straight shank drill of high speed tool steel, JIS SKH59, and a water-soluble lubricant, at a feed of 0.20 mm/rev and a revolution of 980 rpm. In the oil-hole-drilling, there was counted the number of drilled crankshafts until the drill became disabled due to failure of the top cutting edge of the drill. The number of the drilled crankshafts was defined as a machinability index indicative of machinability of steel.

A test piece was obtained from each of the crankpins (70 mm diameter) of the above-mentioned near net shape products of crankshafts in accordance with FIG. 3 of JIS G 0555 and with respect to the reference line which passes a position as deep as 15 mm from the surface of the crankpin. In each of the obtained test pieces, the mirror-like polished surface to be observed measured 15 mm (width) by 20 mm (height). The polished surface was observed through an optical microscope at 400 magnifications over a range of 60 visual fields. Through the observations the index of cleanliness in terms of titanium carbosulfides in the steel was measured such that titanium carbosulfides were distinguished from other inclusions, and also the maximum diameter of titanium carbosulfides was obtained. Subsequently, the mirror-like polished surface of each test piece was etched with nital. The etched surface was observed through the optical microscope at 100 magnifications so as to observe the state of microstructure, i.e. to obtain the occupancy rate (area percentage) of individual constituent phases of microstructure. Further, test pieces were obtained from each of the crankshafts, in parallel with the axial direction of the crankshaft. The obtained test pieces were JIS No. 14A tensile test pieces, Ono-type rotating bending fatigue test pieces (diameter of straight portion: 8 mm; length of straight portion: 18.4 mm), and JIS No. 3 impact test pieces (2 mm U-notch Charpy test pieces), which were used for testing tensile strength, fatigue strength (fatigue limit), and toughness (impact value), respectively, at room temperature.

Table 15 shows the results of the above tests. Table 15 also contains quenching and tempering conditions for test Nos. 68, 69, 73, 79, and 80.

As seen from Table 15, the near net shape products of crankshafts manufactured from the steel products according to the present invention show excellent machinability. Moreover, the crankshafts manufactured from the steel products according to the present invention are superior, in balance between strength and toughness, to the crankshafts manufactured from the steel products of the comparative examples.

TABLE 15

| Test No. | Steel | Titanium carbosulfide: Maximum diameter (μm) | Titanium carbosulfide: Index of cleanliness | Microstructure: F (%) | Microstructure: P (%) | Microstructure: B (%) | Microstructure: M (%) | Mechanical properties: Tensile strength TS (MPa) | Mechanical properties: Fatigue limit σw (MPa) | Mechanical properties: Endurance ratio σw/TS | Mechanical properties: Charpy impact value (J/cm²) | Mechanical properties: Number of drilled crankshafts | Quenching & tempering conditions: Heating temperature for quenching (°C.) | Quenching & tempering conditions: Heating temperature for tempering (°C.) |
|---|---|---|---|---|---|---|---|---|---|---|---|---|---|---|
| 67 | 1 | 0.4 | 0.07 | 21 | 18 | 61 | 0 | 854 | 336 | 0.39 | 67 | 51 | — | — |
| 68 | 6 | 8.1 | 2.10 | 0 | 0 | 57 | 43 | 850 | 334 | 0.39 | 66 | 52 | 890 | 550 |
| 69 | 36 | 3.4 | 0.04 | 0 | 0 | 55 | 45 | 852 | 334 | 0.39 | 105 | 13 | 900 | 550 |
| 70 | *37 | 0.6 | 0.11 | 95 | 5 | 0 | 0 | 848 | 325 | 0.38 | 66 | 15 | — | — |
| 71 | *38 | 0.1 | 0.02 | 51 | 36 | 13 | 0 | 851 | 336 | 0.40 | 86 | 16 | — | — |
| 72 | *39 | 1.2 | 0.15 | 15 | 33 | 52 | 0 | 845 | 318 | 0.38 | 89 | 18 | — | — |
| 73 | *40 | 9.2 | 0.51 | 0 | 0 | 94 | 6 | 850 | 326 | 0.38 | 105 | 11 | 890 | 550 |
| 74 | 47 | 6.3 | 0.23 | 25 | 75 | 0 | 0 | 832 | 382 | 0.46 | 66 | 78 | — | — |
| 75 | 48 | 7.0 | 1.18 | 58 | 42 | 0 | 0 | 880 | 401 | 0.46 | 64 | 80 | — | — |
| 76 | 49 | 7.3 | 1.23 | 22 | 78 | 0 | 0 | 862 | 431 | 0.50 | 64 | 80 | — | — |
| 77 | 55 | 7.2 | 0.59 | 45 | 0 | 55 | 0 | 860 | 421 | 0.49 | 90 | 78 | — | — |
| 78 | 56 | 5.5 | 0.22 | 24 | 0 | 76 | 0 | 846 | 406 | 0.48 | 90 | 78 | — | — |
| 79 | 60 | 3.3 | 0.06 | 0 | 0 | 2 | 98 | 827 | 430 | 0.52 | 107 | 80 | 890 | 550 |
| 80 | 61 | 6.9 | 0.40 | 0 | 0 | 2 | 98 | 857 | 446 | 0.52 | 105 | 81 | 900 | 550 |

In the "Microstructure" colum,
F denotes ferrite,
P denotes pearlite,
B denotes bainite, and
M denotes martensite.
The values marked with *, fall outside the conditions specified by the present invention.

INDUSTRIAL APPLICABILITY

Since the steel products of the present invention have excellent machinability and excellent balance between strength and toughness, they can be used as steel stocks of structural steel parts for a variety of machinery such as transportation machinery including automobiles, machinery for industrial use, construction machinery, and the like. Various kinds of structural steel parts for machinery can relatively readily be manufactured from the steel products of the present invention through machining.

We claim:

1. A steel product which exhibits excellent machinability and which has the following chemical composition based on % by weight: C: 0.05% to 0.6%; S: 0.002% to 0.2%; Ti: 0.04% to 1.0%; N: 0.008% or less; Nd: 0% to 0.1%; Se: 0% to 0.5%; Te: 0% to 0.05%; Ca: 0% to 0.01%; Pb: 0% to 0.5%; and Bi: 0% to 0.4%, wherein the maximum diameter of titanium carbosulfide contained in the steel is not greater than 10 μm and its amount expressed in the index of cleanliness of the steel is equal to or more than 0.05%.

2. The steel product according to claim 1, wherein the maximum diameter of titanium carbosulfide contained in the steel is 0.5 to 7 μm, and its amount expressed in the index of cleanliness of the steel is 0.08–2.0%.

3. The steel product according to claim 1, wherein not less than 90% of the microstructure is constituted by ferrite and pearlite.

4. The steel product according to claim 1, wherein not less than 90% of the microstructure is constituted by bainite, or ferrite and bainite.

5. The steel product according to claim 1, wherein not less than 50% of the microstructure is constituted by martensite.

6. A non-heat-treated steel product, according to claim 1, which has the following chemical composition based on % by weight, C: 0.2% to 0.6%; Si: 0.05% to 1.5%; Mn: 0.1% to 2.0%; P: 0.07% or less; S: 0.01% to 0.2%; Al: 0.002% to 0.05%; Cu: 0% to 1.0%; Ni: 0% to 2.0%; Cr: 0% to 2.0%; Mo: 0% to 0.5%; V: 0% to 0.3%; Nb: 0% to 0.1%; and the balance: Fe and unavoidable impurities, wherein at least 90% of the microstructure of the steel is constituted by ferrite and pearlite.

7. The non-heat-treated steel product, according to claim 6, wherein the maximum diameter of titanium carbosulfide contained in the steel is 0.5 to 7 μm, and its amount expressed in the index of cleanliness of the steel is 0.08–2.0%.

8. The non-heat-treated steel product, according to claim 6, which satisfies at least one of the following conditions: ferrite accounts for 20–70% in terms of the area percentage; ferrite grain size is 5 or more; and the average lamellar spacing of pearlite is 0.2 μm or less.

9. The non-heat-treated steel product, according to claim 6, which satisfies at least one of the following conditions: the value of fn1 as expressed by the following equation (1) is greater than 0%; the value of fn2 as expressed by the following equation (2) is not less than 2:

$$fn1=Ti(\%)-1.2S(\%) \quad (1)$$

$$fn2=Ti(\%)/S(\%) \quad (2).$$

10. A non-heat-treated steel product, according to claim 1, which has the following chemical composition based on % by weight, C: 0.05% to 0.3%; Si: 0.05% to 1.5%; Al: 0.002% to 0.05%; Cu: 0% to 1.0%; Mo: 0% to 0.5%; V: 0% to 0.30%; Nb: 0% to 0.1%; B: 0% to 0.02%; and the balance: Fe and unavoidable impurities, wherein the value of fn3, expressed by the following equation (3), is in the range of 2.5–4.5%, and at least 90% of the microstructure of the steel is constituted by bainite, or ferrite and bainite:

$$fn3=0.5Si(\%)+Mn(\%)+1.13Cr(\%)+1.98Ni(\%) \quad (3).$$

11. The non-heat-treated steel product, according to claim 10, wherein the maximum diameter of titanium carbosulfide contained in the steel is 0.5 to 7 μm, and its amount expressed in the index of cleanliness of the steel is 0.08–2.0%.

12. The non-heat-treated steel product, according to claim 10, which satisfies at least one of the following conditions, the value of fn1 as expressed by the following equation (1) is greater than 0%; the value of fn2 as expressed by the following equation (2) is not less than 2:

$$fn1=Ti(\%)-1.2S(\%) \quad (1)$$

$$fn2=Ti(\%)/S(\%) \quad (2).$$

13. A heat-treated steel product, according to claim 1, which has the following chemical composition based on % by weight, C: 0.1% to 0.6%; Si: 0.05% to 1.5%; Mn: 0.4% to 2.0%; Al: 0.002% to 0.05%; Cu: 0% to 1.0%; Ni: 0% to 2.0%; Cr: 0% to 2.0%; Mo: 0% to 0.5%; V: 0% to 0.3%; Nb: 0% to 0.1%; B: 0% to 0.02%; and the balances Fe and unavoidable impurities, wherein at least 50% of the microstructure of the steel is constituted by martensite.

14. The heat-treated steel products according to claim 13, wherein the maximum diameter of titanium carbosulfide contained in the steel is 0.5 to 7 $\mu$m, and its amount expressed in the index of cleanliness of the steel is 0.08–2.0%.

15. The heat-treated steel products according to claim 13, which satisfies at least one of the following conditions: the value of fn1 as expressed by the following equation (1) is greater than 0%; the value of fn2 as expressed by the following equation (2) is not less than 2:

$$fn1=Ti(\%)-1.2S(\%) \quad (1)$$

$$fn2=Ti(\%)/S(\%) \quad (2).$$

16. A machined steel part made of the steel product as described in claim 1.

17. A machined steel part made of the non-heat-treated type steel product as described in claim 6.

18. A machined steel part made of the non-heat-treated type steel product as described in claim 10.

19. A machined steel part made of the heat-treated type steel product as described in claim 13.

20. The steel product according to claim 1, wherein S: 0.025 to 0.2%.

21. The steel product according to claim 1, wherein Si: 0.3 to 1.3%.

22. The steel product according to claim 1, wherein Mn: 0.4 to 2.0%.

23. The steel product according to claim 1, wherein P: 0.015 to 0.039%.

* * * * *